US005249827A

United States Patent [19]

Olson

[11] Patent Number: 5,249,827

[45] Date of Patent: Oct. 5, 1993

[54] PUBLICATION REFERENCE-AID SYSTEM APPARATUS THEREFOR

[76] Inventor: Craig W. Olson, P.O. Box 302, Fontana on Geneva Lake, Wis. 53125

[21] Appl. No.: 874,555

[22] Filed: Apr. 13, 1992

Related U.S. Application Data

[63] Continuation-in-part of Ser. No. 628,425, Dec. 14, 1990, abandoned, which is a continuation-in-part of Ser. No. 504,912, Mar. 30, 1990, Pat. No. 5,056,824, which is a continuation-in-part of Ser. No. 388,319, Jul. 31, 1989, Pat. No. 5,011,189, which is a continuation-in-part of Ser. No. 147,366, Jan. 25, 1988, abandoned, which is a continuation-in-part of Ser. No. 940,422, Dec. 11, 1986, abandoned.

[51] Int. Cl.[5] ..... B42D 15/00

[52] U.S. Cl. ..... 283/36; 281/31; 283/41; 283/42; 283/81; 283/117

[58] Field of Search ..... 283/36, 67, 81, 117, 283/41, 42; 281/31

[56] References Cited

U.S. PATENT DOCUMENTS

| | | | |
|---|---|---|---|
| 3,290,059 | 12/1960 | Newman | 281/3 R |
| 3,582,111 | 6/1971 | Süter | 281/3 R |
| 3,958,816 | 5/1976 | Remmey, III | 283/42 |
| 4,235,459 | 11/1980 | Callahan | 283/81 |
| 4,329,191 | 5/1982 | Barber | 156/64 |
| 4,500,021 | 2/1985 | Bildusas | 128/40 |
| 4,580,815 | 4/1986 | Barber | 283/81 |
| 4,614,361 | 9/1986 | Foster | 283/81 |
| 4,636,432 | 1/1987 | Shibano et al. | 428/327 |
| 4,643,455 | 2/1987 | North et al. | 283/81 |
| 4,752,087 | 6/1988 | Weisbach | 283/81 |

*Primary Examiner*—Paul A. Bell

[57] ABSTRACT

A reference-aid article which can be used as an index marker, game marker, or coupon marker is disclosed. The reference-aid is formed from a multi-faced substrate which is adapted to accept information on at least one of the faces. The substrate also has at least one marker member (18) and at least one removably protective substrate means (21) releasably attached to the substrate.

20 Claims, 17 Drawing Sheets

PUBLICATION REFERENCE-AID SYSTEM APPARATUS THEREFOR

CROSS-REFERENCE TO RELATED APPLICATIONS

This application is a continuation-in-part of Ser. No. 628,425, filed Dec. 14, 1990, now abandoned, which is a continuation-in-part of Ser. No. 504,912, filed Mar. 30, 1990, now U.S. Pat. No. 5,056,824, issued Oct. 15, 1991 which is a continuation in-part of Ser. No. 388,319, filed Jul. 31, 1989, now U.S. Pat. No. 5,011,189, issued Apr. 30, 1991, which was a continuation-in-part of now abandoned application Ser. No. 147,366, filed Jan. 25, 1988, which was a continuation-in-part of now abandoned application Ser. No. 940,422, filed Dec. 11, 1986.

FIELD OF THE INVENTION

The field of this invention relates to reference-aid article/devices. More particularly, this invention illustrates a readily adaptable reference device for incorporation with various kinds of publication articles/vessels and other substrates; a reference article/aid apparatus being improved and capable of being economically manufactured in a multitude of methods to accomplish the same desired end means; a reference-article apparatus which is adapted to be either supplied with a publication article and issued therewith or in the alternative, is manufactured as a stationery product, as a publication means vessel, in form. Examples of the reference-aid are index markers, game/coupon markers.

BACKGROUND OF THE INVENTION

The Information Age has produced a glut of information which has created an important reference retrieval/standardized indexing concern not only for librarians, but also to students, teachers, business and professional people, as well as general readers alike who gather and store various types of publication articles such as periodicals, portfolios (pocket or without), guides, directories, trade publications, including music record albums, compact and floppy discs, coin/stamp/-photograph albums and the like. For example, in the case of periodical publications like mail order catalogs, journals, magazines, etc., the constant flow of information can stack and pile up in a rather short period of time, resulting in severe mental anguish in relocating poorly marked reference sources, if at all. For this reason, publishers of some publications provide outside cover information, table of contents and seldomly an index at the close. This results in an amount of information which is necessarily associated with a reader-user but inconsistently possible to store collectively in a systematic and uniform manner and therefore discarded early or lost.

Reference markers are customarily packaged in different quantities which may include combinations of colors, and various shapes and sizes. Although in the past, loose single sheets have been inserted between the pages at the gutter margin to indicate reading passage locations. Other unorthodox methods commonly used consist of "dog-eared" page corners, inscribing the text portion or highlighting lines, if a marker is convenient, all of which are detrimental to the preservation and conservation of reference material according to the American Library Association.

Publication products are often subscribed to due to special interests which further add to the accelerated flow of personally needed information. Understandably, the systematic organization associated with the publication product becomes of secondary importance under these conditions. Thus, it is not uncommon for information as to the date of publication, issue number, special articles of interest, important statements, etc.—to go unmarked or be missing entirely from the dusty collection of publications due to the fact that it is not apparent to the user-reader the material may be only misfiled.

As a result, much inconvenience and wasted time is encountered by the researcher-user whose ability to access and retrieve needed information is dramatically inhibited forcing the researcher to a subsequent course of action for which he may regret that is due to his dependency, in part, on the necessary information unable to be produced upon demand. Not only is this undesirable from a researcher's point of view, but from the user who is interested in managing his vast publication collections for inventory control purposes since the documentation may be very sketchy.

Unfortunately, until the present invention, the burden of developing and establishing some organized and systematic methods of accessing and retrieving information lied individually in the initiative of the researcher-user to incorporate his own suitable technique in practice.

Examples of prior art relating to indexing devices is both historical and crowded as indicated by the following patents known to applicant. A continued search was conducted in U.S. Patent Depositories, prior to filing this application, for the most recent patents issued within the following Classes/Subclasses: 283/35-42; 40/78; 40/2; 35/35R; 35/43; 116/119 and 428/42. Cited references are those found to be most pertinent within the foregoing classes of study.

| | | |
|---|---|---|
| 4,696,491 | Stenger | 1987 |
| 4,680,210 | Corcoran | 1987 |
| 4,596,407 | Suska | 1986 |
| 4,437,685 | Valencia | 1984 |
| 4,019,759 | Stanton | 1977 |
| 3,958,816 | Remmey | 1976 |
| 3,680,229 | Serrie et al. | 1972 |
| 3,583,358 | Hanson | 1971 |
| 3,561,147 | Valencia | 1971 |
| 3,535,804 | Cunningham | 1970 |
| 3,473,827 | Leadbetter | 1969 |
| 3,463,515 | Thompson | 1969 |
| 3,324,823 | Peters | 1967 |
| 2,590,615 | Heckendorn | 1952 |
| 2,314,578 | Erb | 1943 |

U.S. Pat. Nos. 4,696,491; 4,680,210; 4,596,407; and 4,437,685 constitutes the most advanced developments with which the present invention is concerned.

Stenger and Suska both disclose an information retrieval system each employing the use of loose-leaf binders. Stenger discloses an information indexing system for a recipe reference book whereby a supply of preprinted abstract pages found in a separate appendix section are selected and removed for placement among a plurality of alphabetic sections. Suska disclosure was cited for its merits in periodical storage and retrieval, where Suska claims and illustrates a duplicate index page to be constructed with the periodical adapted to be removed for separate storage in a loose-leaf binder. Both patents do not teach the present invention which is a reference-aid/article apparatus being temporarily secured to and removable from a publication and mountable thereon by a user; the device utilizing self-adhering and/or pressure sensitive releasable and/or reusable adhesive layer(s).

In U.S. Pat. No. 4,680,210, Corcoran discloses repositionable markers having a laminated liner on one face, the markers manufactured as a generic stationary product and positioned in intermeshed pairs having alternation orientation on adhesive strips. This disclosure does not teach marker(s) of the present invention which may have articulated and/or non-articulated release cover means and being optionally intermittently severed permitting the user to select and remove one marker with one release covering, if desired. The release cover means and marker substrate each being formed/defined from the same substrate or different substrates—these features are untaught by Corcoran and therefore distinguishes the present invention adequately therefrom.

U.S. Pat. Nos. 4,437,685 and 4,019,759, Valencia and Stanton, respectively, disclose indexing devices for reference directories. Valencia teaches a novel book index marker device which is inserted between the pages of a book with the indexing indicia disposed above and below the top and bottom edges of the book being secured in place by an elastic band extending externally of the spine of the book. Stanton also discloses a version of an index device employing the use of elongated flat transparent plastic index tabs, each being affixed by a strip of transparent adhesive tape. Both indexing devices and securement used in each are not the same as the present invention which utilizes at least one adhesive layer means where the mounting surface layer is remountable (at least once) by a user.

In U.S. Pat. No. 3,958,816 Remmey teaches notation related book markers which use learning key cards that relate to the tabs, the tabs corresponding to key cards stored in a mountable envelope jacket mounted to the inside of a book; the envelope holding unused tabs detachable therefrom. Further, Remmey teaches the markers having identification marks in opposite directions and that both the adhesive area and identification mark area each occupy one-half of the tab, each area being a substantially square area. Other numerous distinguishable differences lie between the Remmey disclosure and the present invention. Remmey teaches an "after-market" product and does not disclose a temporarily secureable and remountable reference-aid employing at least one adhesive layer means on at least one face thereof having a preferred releasable and reusable pressure sensitive mounting layer being directly or indirectly applied to at least one face surface of the marker. Further, he does not teach the feature of a multi-functional substrate (with or without a release coating means thereon) from which at least one marker member and/or at least one release cover means may be defined/shaped therefrom; the use of the same or different substrates to define each desired apparatus element aforesaid, nor at least one attaching means area on at least one marker face thereof.

In U.S. Pat. No.3,680,229 Serrie et al, discloses a reading level apparatus having matched symbols of two series using a permanent adhesive on one face, indicating a level of student reading ability and a level of book reading difficulty. The disclosure does not teach a temporarily securable reference-aid apparatus for use with a paginated or non-paginated publication vessel/article adapted to be remountable thereon and to other publication vessels by a user. Further, an information means area is not taught to comprise not only both non-adhesive faces of the apparatus substrate, but in addition, to include the attaching means area to which at least one adhesive layer means is applied thereto, wherein a substantially flexible liner means may be therebetween two adhesive layers.

U.S. Pat. No. 3,583,358 shows an assembly of marker tabs separably removable from a matchbook-like holder for marking pages of a book. Hanson does not teach the use of a separably removable and mountable directory corresponding to markers, nor does he disclose an apparatus temporarily secured as a part of a publication during manufacture as taught by the present invention.

U.S. Pat. No. 3,561,147 is cited as an example of a book index prefabricated as an insert leaf adapted to mount between the leaves of a reference directory which has an outwardly folded tongue reversely folded and threaded through an appropriate precut slit to provide a triple ply tab. Valencia does not disclose an apparatus being temporarily secureable to and remountable on a publication vessel/article, nor is the use of a separably remountable/mountable directory and/or file head tab discussed. Valencia does not teach the meritorious functions of the present invention.

In U.S. Pat. No. 3,535,804 Cunningham shows a page-edge reinforcing device and method of mounting to a "thin" directory page, where successive adjacent tabs are displaced serially when the apparatus is mounted on appropriate pages of a book longitudinally in alignment with the edge. This patent does not discuss the use of at least two determined indicia means having an associative relationship between markers and/or between the directory. The objects and functions are substantially different than those of the present invention.

Leadbetter, in U.S. Pat. No. 3,473,827, illustrates a permanently mounted directory with separably connected index tabs to the body of a page of a book, the tabs being a folding type with transverse fold lines on the rectangular tabs intermediate their length. Leadbetter does not disclose the present invention which has indentification areas on both faces of the markers, an apparatus which is temporarily secured with a publication—including a separably removable directory for mounting thereon, machine readable indicia to be accepted, an intermittently severed releasable covering adapted to be imprinted on at least one face nor a substantially transparent adhesive adapted to be colored.

U.S. Pat. No. 3,463,515 was selected for showing another indexing device of transparent material having a disc-shape and transparent adhesive, and utilizing an identification character on each tab for facilitating alignment with each other. The indexing apparatus disclosed is not the same as the present invention, further, no intermittently severed releasable protective covering is discussed nor is the system taught to be included during manufacturing of a publication.

U.S. Pat. No. 3,324,823 illustrates Peters disclosing an earlier version of U.S. Pat. No. 4,437,685 (1984) issued to Valencia wherein a book mark device comprising a plurality of markers, being not less than substantially the same size as a page of a book and having a tab portion opposite the inserted edge, is inserted between adjacent pages of a book into the gutter and banded by a resilient member extending around the pages adjacent the spine. This disclosure, being more closely related and similar to Valencia, however, is distinctly different from the numerous accomplishments which the present invention employs.

Heckendorn in U.S. Pat. No. 2,590,615 was selected for showing a removable page and bookmark having a formed tab with friction material at the point adapted to wedge the bookmark between the leaves of a book, to secure the book mark in position. Heckendorn does not teach the present invention having removably mountable apparatus members for mounting to a paginated or non-paginated publication.

In U.S. Pat. No. 2,314,578 Erb discloses a pair or pairs of co-acting index tabs being permanently secured by moistened adhesive or by a strip of "Scotch" tape being severed to remove the tab from the page. Erb does not discuss utilizing an intermittently severed releasable protective covering, being adapted to be imprinted on at least one face, substantially transparent adhesive adapted to be colored, nor the employment of reciprocally cooperating "cross-matched" identification indicia corresponding to a mountable directory having "like" identification indicia. This indexing device is not the same as the present invention.

No prior art disclosures suggest the accomplishments of the present invention.

SUMMARY OF THE INVENTION

The improved apparatus of the present invention may consist of at least one of three component members, individually, groups or in combinations of elements. Such reference-marking apparatus may be utilized with either or both paginated and non-paginated types of publication vessels/articles means, e.g. directories, magazines, books, periodicals, in general, etc., and compact discs, cassette tapes, coin/stamp/record/photograph albums and the like, respectively. The invention in its simplest form may be created from substantially multi-faced and/or double-faced substrate (sheet stock) or substrates from which at least one element of the apparatus is fabricated therefrom. These elements comprise at least one marker member (primary and/or secondary markers), at least one release cover means, at least one mountable/remountable directory portion and any other support panel portion, retaining panel, common panel portion or otherwise as an option to the apparatus. The remote directory portion may have optionally a file head tab for the purpose of inscribing or identifying a publication vessel/article means to which its mounting is intended. The directory carries at least one potentially mutually corresponding information means (codes, indicia, colors, etc.) which may have a determined/pre-determined associative relationship to selected markers and/or selected faces thereof. However, in the case of the apparatus designed to be a game marker, the substrate may be multi-faced and/or three-dimensional in its construction. Other uses of the apparatus include product sampler marker vessels (e.g. perfume scented), coupon/redemption marker vessels, and any other suitable use for an apparatus having the features and characteristics disclosed herein. Each element comprising the apparatus may be defined/formed/-shaped by line means taken from the group consisting of at least one of imaged line means, tear lines, weaken line means, score line means, fold line, die cut line means, perforation line means, and combinations thereof. Such line means affording separation may be continuous line means, intermittent line means and combinations thereof. The apparatus may be production-assembled "in-line" and/or "off-line" as a publication vessel itself in the form of a stationery product or in the alternative, the article apparatus may be supplied with and issued with at least one publication vessel means. Supplementation means to a publication vessel is defined to include an apparatus integrally formed from a part of the physical material comprising the publication or supplemented in the form of an insert, etc. thereto. The apparatus may further be insertedly disposed therebetween the interior contents of the publication and/or externally disposed therewith for distribution means, perhaps within an over-wrap packaging means, envelope, etc. Alternately, the envelope means and/or other packaging means could include the apparatus integrally formed therewith as they, too, are publication vessel means. Further, even pocket and pocketless portfolios may, too, be integrally formed with the apparatus as a convenience to the user thereof. The apparatus substrate means may optionally be adapted to accept-/receive/display imaging means, (color-coding, bar coding, printing and the like) on one or more face surfaces thereof. Another basic element to the apparatus which is employed is that at least one adhesive layer means which provides a mounting exposing surface layer is a preferred releasable and/or reusable pressure sensitive adhesive layer substance which is applied directly or indirectly to at least one attaching means area. At least one release cover means covers the attaching means area and upon being separably removed therefrom by a user, the mountable exposed surface layer(s) provides adherence of the apparatus element to the desired publication vessel means. At least one edge portion of the at least one release cover means may extend beyond the attaching means area to facilitate removal of the covering, (perhaps by using a finger nail) from the adhesive layer thereunder. It is important to state that the peeling forces may only minimally remove some adhesive particulate but that generally the forces are not substantial to remove the at least one adhesive layer means from the attaching means area or areas. The release cover means may be of a treated and/or untreated type material meaning with or without a release coating means. Therefore, it is quite possible that the release cover means may be adapted to be imaged thereon one or more faces thereof with various types of readable means information means. The release cover means may be substantially flexible, substantially semi-flexible, substantially semi-rigid and substantially rigid in its properties and may thereby carry at least one marker member means and/or at least one directory portion thereon. In the reverse thought, at least one marker means and/or combination of such at least one directory portion means may each carry at least one release cover means thereon.

Should two or more adhesive layers be utilized, a liner means may be optionally sandwiched therebetween such at least two layers. Each adhesive layer means and/or liner means may be optionally substantially opaque, substantially transparent, and substantially translucent or be combinations thereof as well as further being optionally adapted to receive/accept readable means information means thereon. Upon removal of the apparatus member from the substrate surface of a publication vessel/article means, the mounting/exposing adhesive layer is substantially removed from the publication vessel substrate surface, however some minimal non-damaging residue may remain on the publication substrate depending upon the integrity of the product the user selects. In the alternative, a more aggressive adhesive mounting exposing layer may "pick" fragments of the publication substrate which tends to "cling" to the mounting adhesive layer surface thereof. The preferred adhesive, of course, is one which would be completely removable from the publication vessel substrate means. Although in application, some adhesive substances employed as categorically described herein shall not be construed to be a departure herefrom simply due to unfavorable adhesion properties which may fall short of the preferred adhesive characteristics as aforementioned. It is to be noted that the adhesive substance or substances employed may be each of a solvent base substance or a water base substance depending upon user concerns. Further, each adhesive layer utilized is at least sufficient to adhere to the apparatus substrate, and the mounting exposing surface layer is at least sufficient to at least secure the apparatus member to a publication substrate means and the at least one adhesive layer means has at least sufficient adhesion properties to at least hold and maintain the employed apparatus member in position, temporarily securable to at least one publication substrate vessel means. It should be noted that if two or more adhesive layers are employed, the apparatus substrate attaching layer is substantially more aggressive than the mounting surface layer which engages and disengages to the publication vessel/article to substantially obviate separation of the layer from the apparatus substrate under peeling forces and/or apparatus removal forces from the publication vessel means.

The apparatus substrate may be of preferred substantially flexible sheet stock substrate which may further be adapted to carry and/or receive a scented slurry means thus generating added marketing potentials to the product/apparatus. The scent may be of a perfume fragrance or may be odifierous in use as a warning symbol or depending upon the use; the scent may fall somewhere inbetween, if desired. The apparatus substrate may carry at least one scent thereon as an option element thereto. The apparatus substrate may be substantially flexible, substantially semi-flexible, substantially semi-rigid and substantially ragid depending upon the user and the purposeful intent to which it is to serve. The defined formed shape of each apparatus member designed may be each generally geometrical, generally modified-geometrical and irregular in configuration. The apparatus substrate may further be capable of receiving inscribable/imprintable information means thereon at least one face of such apparatus member, or in the alternative may not permit further coding based on the material employed by the user. The substrate may be specially coated and/or treated to accept information means in restricted and/or selected areas thereon, if desired. As discussed earlier, the apparatus substrate is also capable of carrying at least one adhesive layer means on at least one face thereof depending upon intended function and application.

The reference-marker apparatus discribed herein may be well suited for other applications and functions other than for general indexing purposes. These "other" applications include game markers, coupon/redemptional markers, product samplers and the like, all of which comprise the base ingredient elements as those defining the reference-marker as merely an indexing tool. Another functional application is to employ the reference-marker not only as a "page" marker, but to include the practical function of the reference-marker as a substitute for commonly known section dividers used in books, catalogs, directories, guides, etc. The present invention from the standpoint of material usage is respectful of and in keeping with material conservation as it utilizes less sheet stock (substrates) than such section dividers would utilize. This is due to the ability to define/form/shape at least one marker member means form the substrate means by at least one line means designed to entirely or partially "outline" to shape at least one apparatus member (marker and/or directory) from at least one substrate means. This means that should a designer wish to form one or more marker members from the same or different substrates it is entirely feasible as they are defined/formed by at least one line means and/or separation line means, either continuous or interrupted lines.

Further, the apparatus substrate may be partially or entirely protected from wear and tear by application of at least one coating means which may be optionally applied to one or more surfaces of the reference-marker means as indicated. This coating means may be the same or different coating as the coating aforedescribed which was intended to be a writable/inscribable entry surface, as perhaps a reserved area.

In a further note, each adhesive layer means utilized may be be at least one of substantially opaque, substantially transparent and substantially translucent. Each adhesive substance layer employed may be at least one of commercially available and non-commercially available and still be in keeping with the present invention. Although the preferred adhesive as detailed herein may be releasable and/or reusable in performance, the adhesive layer means (at least one) on the directory portion with or without a file head tab or only file head tab may use a substantially more aggressive adhesive layer means to temporarily mount and/or permanently mount the reference apparatus to the selected publication. Each adhesive layer means may be from the group consisting of substantially permanent adhesive layer means, substantially temporary adhesive layer means, substantially semi-permanent adhesive layer means and semi-temporary adhesive layer means or combination or range of adhesion inbetween.

The main (primary) marker member bears the information means area occupying substantially each face (front and rear) thereof. In addition, the information means area may employ identification indicia, preferably located on the marker portion (head) which extends beyond and overlies the edge, assigned to identify the publication for rapid referencing and inventory control purposes that may be of a visual and/or machine readable type, perhaps like an optically scannable bar-code for example. The visual information, such as the publication title, issue date, volume number, etc. may appear adjacent the machine readable information. The machine readable information permits instruments, such as a laser wand, to send information to the computer for the reason of enacting a particular function. The easily accessible information on the extended portion of the marker eliminates the removal of any publication means from its position in storage. The present invention has at least one information means area of the apparatus adapted to accept a machine readable identification indicia. Further, the one face (front) of the primary marker is occupied substantially by the information means area, permitting many forms of information to be utilized such as advertising, inscribable directories, publication information, multiple identification indicia and the like. At least one face of each marker member and- /or directory portion carries at least one attaching means area being covered thereover by at least one adhesive layer means substance which overlies the optional information means area thereunder such adhesive layer(s) as determined on the multi-faced substrate. Should multiple inscribable entry areas be required, the adjacent identification indicia indicating a particular entry area or areas may be variated to differentiate designated areas from one another. In this variation of the apparatus, with the directory being a part of the main (primary) marker, the need for a separately mountable "non-marker" directory would be eliminated. Each individual apparatus member may be temporarily secured with the publication at the time of manufacture without the need and cooperation of the other members.

Each cooperating identification indicia on the directory employed may have at least one corresponding inscribable entry area or (secondary) marker bearing the "like" matched indicia, the "like" indicia cooperating in reciprocal "cross-matching" relationship to the directory or perhaps each other. The inscribable entry area portion on the directory is provided for hand written notations of "general" subjects, articles of interest while the markers (secondary) are for notations of more specific information to be indicated on the information means area, both for assisting in future review of the publication material.

Similarly, the double-faced and/or multi-faced substrate consisting of at least one marker member has the information means area occupying substantially at least one face of each adheringly mountable marker member. Each of said at least one face having at least one attaching means area portion being occupied/covered entirely or partially by at least one adhesive layer means substance (curable liquid layer or roll-on means layer) which may overlie an optional information mean area. Should the adhesive layer or layers be substantially transparent, for example, this would allow any information on the multi-faced substrate thereunder to be readable by visually scannable means, mechanical means and electroncial means. Overlying one or more adhesive layers attached to at least one face of the apparatus is at least one of permanently, semi-permanently, semi-temporarily and temporarily, at least one releasable cover means being optionally adapted to carry information means on at least one face thereof and which covers such adhesive layer or layers of the apparatus. The releasable cover means being also multi-faced may be optionally severed by at least one separation line means which either forms such releasable cover means from at least one substrate or in the alternative segments and defines such apparatus element therefrom as one example. One portion and/or edge of the releasable cover means may optionally extend beyond the adhesive layer means thereunder to facilitate and expedite the peel-away removal of the releasable cover means from the adhesive layer means.

The information means area of each marker (primary and/or secondary) faces is provided to receive many forms of information, for example, trademarks, machine means readable information, color-code means and scannable image means (visable or invisible) as well as inscribable entry area(s) for personal hand-written notations. Each mutually cooperating entry area and/or identification indicia of a "like" type may participate in a determined/pre-determined associative relationship with respect to each other. The number of matched sets of corresponding indicia and participating apparatus members to be employed depends on the designer of the apparatus. It is important to note, one or more subordinate marker members may correspond to at least one "cross-matching" inscribable entry area or areas located on the information means area of the directory, or any other apparatus member. At least two "like" identification means indicia comprise a matched set allowing the "like" identification means indicia to reciprocally correspond in a determined associative relationship with each other, each of the matched sets of the identification means indicia being variated to differentiate groups of "like" identification means indicia from each other to aid the user during review of material.

The preferred marker shape may be substantially rectangular for simplicity sake in practice, however more creative configurations, perhaps more practical, may be utilized by the designer at will and still remain in keeping with the present invention, such as substantially geometric, substantially modified-geometric or perhaps irregular design shaped markers which also encompasses the mountable directory apparatus member to be designed. The mind is the only limiting factor with respect to possibilities of the present invention. Usually the information imprinted on both faces of a particular apparatus member would be variated due to advertising and/or information requirement needs. However, in some instances, the multiple usage of information on both faces of the desired apparatus member may need to be employed, where it is appropriate to utilize identical indicia, advertising, etc., back-to-back. In addition, miscellaneous information may be incorporated on the information means area, such as prize winning games, instructions, directions, additional advertising space, etc. which may be readable under at least one adhesive layer means being at least one of substantially transparent and substantially translucent. The total apparatus or just selected members provided by serve as a advertising medium and/or premium item when included with and/or issued as publication vessel means. The apparatus may be produced as a stationery device/product and still be in keeping with the scope of the present invention.

The third apparatus member is the separably removable and mountable directory, a non-marker member of the apparatus, also constructed from the same or different sheet stock remote from the markers. This apparatus member, employed at the option of the designer, is also temporarily secured with the publication at the time of manufacture, making separation and removal therefrom convenient and simple by the user. The mountable remote directory is a substantial improvement over prior art being formed by at least one separable line from sheet stock. One face of the mountable directory member is occupied substantially by the information means area having at least one inscribable entry area portion overlying the information means area. In this portion, each cooperating entry area is identified by an adjacent identification indicia distinguishing one entry area from another. The matched sets of at least two cooperating identification means indicia have a determined/predetermined mutually "cross-matching" associative relationship with matchable information on at least one cooperating marker, if any are employed, or to other directory inscribable entry areas designated by a "like" indicia. The opposite one face (rear) of the mountable directory has an attaching means area portion which overlies the information means area that substantially occupies the one face. The attaching means portion is occupied by at least one adhesive layer means substance being originally covered by multi-faced substrate(s) means being at least one releasable cover means which may extend beyond the adhesive beneath to facilitate removal of the covering from the adhesive means; the releasably protective covering is adapted to be imprinted on at least one face of the multiple-faced covering means. The mountable directory may be used in conjunction with or separately from the other apparatus members and is designed to be mounted by a user to a convenient place upon the publication—preferably to the exterior cover panel or the perhaps mounted to a page adjacent the index page or table of contents, should one be provided, serving as to complement. Further, the information area of the directory may employ machine readable identification indicia adjacent the selected inscribable entry areas, for computer interfacing purposes and information storage and retrieval.

Since each apparatus member may be constructed and/or employed independently of one another, at least one apparatus member may be constructed from at least one substrate means being at least one of flexible, semi-flexible, semi-rigid and rigid material by at least one separation line means which forms the apparatus from the sheet stock or suitable substrate means. Further, at least one apparatus member is included as a convenient reference-aid with the publication means during the time of manufacture and, where the apparatus is readily adapted to be separably removable from the publication means and mountable thereon by the user. The apparatus may utilize various size sheets of stock depending on the need felt. For instance, a paginated publication, where the apparatus is being arranged for use in periodicals (magazines), the apparatus may be temporarily secured by being held between adjacent pages, integrally formed from a page to be collated with the publication or be separably removable from a gate fold panel portion by at least one separation line means or any other form as an insert, etc. to be included therewith. The present invention may be originally temporarily secured to a paginated publication by being saddle-stitched (stitched with staples), adheringly retained, perfectly bound (glued in) or otherwise to the spine area of the article. Whatever desirous means of including the apparatus with a publication means at the time of manufacture is another detail left to the discrection of the designer, etc., so long as the apparatus is separably removable from the publication vessel means by a user to permanently, semi-permanently, semi-temporarily, and/or temporarily mount thereon.

As aforementioned, depending upon the kind of publication involved, the apparatus may consist of the markers (primary and secondary type) and the removably mountable directory making referencing and inventory control significantly easier by the researcher-user. The apparatus is designed for complete personalization to rapidly retrieve and access information upon demand. Both the markers and mountable directory may define designated areas for writing brief notations, and the apparatus members are individually mountable and/or remountable (at least once) without being substantially detrimental and/or substantially harmful to the publication substrate means to which one or more apparatus member elements are adheringly mounted thereto. Each adhesive layer means substance consisting of an exterior surface layer being a releasable and/or reusable pressure sensitive adhesive layer may be taken from the group consisting of temporary adhesive substance, semi-temporary adhesive substance, semi-permanent adhesive substance and permanent adhesive. This wide array of adhesive, regardless of classification by categorical name may still permit the adhesive layer means to be substantially releasable and/or reusable entirely or partially in practice without departure herefrom the spirit and scope of the present invention. Each of at least attaching means area may be occupied/covered by at least one adhesive layer means wherein such at least one attaching means area may further occupy less than or greater than one-half of the potential information means area comprising the apparatus substrate means. Decorative adhesive images may also be used in the application of the adhesive such as trademarks, various object shapes, and other desirable adhesive imaging over which such at least one releasable cover means is originally engaged thereto.

The product of the invention may be optionally protectively laminated, either partially or entirely on one or more substrate means face surfaces of each apparatus member. In the alternative, an interior laminant substrate means may be utilized being sandwiched therebetween at least two adhesive layers to act as a reinforcing film in providing the present invention with increased product longevity.

The preferred adhesive to mount and/or remount each apparatus member to a publication vessel means is a releasable and reusable substance, for example, the type used on a "POST-UP" NOTE may be various manufacturers. Upon use of the present invention apparatus, the adhesive is or becomes activated to be used as a self-adhering and/or pressure sensitive type which is directly or indirectly applied to the apparatus member or members. Such selected adhesive substance is the mounting surface layer by which each apparatus member is secured to the desired position upon a publication vessel means. However, the at least one adhesive layer which attaches to the apparatus substrate means may be at least one of permanent, semi-permanent, semi-temporary and temporary. Further, such at least one adhesive layer means is substantially confined to the determined/pre-determined attaching means area or areas and will not leave harmful/destructive residue upon the publication means substrate. Each adhesive layer means may be color tinted or colorized optionally to provide desired affects and features. The application of the coloring and/or see-through adhesive capability enhances the usability of the apparatus over prior art, permitting games, such as lottery numbers, to be revealed upon removal of the releasable cover means. The sum total of the attaching means area or areas is from about 2% to about 99.9% of the information means area of each apparatus members face or faces.

The optionally intermittently severed releasable cover means is functional without the application of at least one release coating and/or impregnated adhesive repellant means applied thereto. The releasable covering means, however, still may optionally be capable of carrying information means on at least one face of the multi-faced substrate means. Example substrates for the releasable cover means include offset stock, polymer means calendered stock, cellophane, enamel stock, mylar, plastic means, film means and the like. In the alternative, depending upon the type of adhesive layer employed, a release film means may be over-coated or penetrated into the releasable cover means substrate. One portion of the release cover means may extend beyond the attaching means area portion which overlies the information means area on at least one face of each apparatus member. Each releasable cover means could also be at least one of substantially transparent, substantially translucent and substantially opaque depending upon user design and intent. There are several methods are available, in the alternative, to fabricate the apparatus with an intermittently severed covering. The releasable covering means (bearing the adhesive on at least one face) may be severed concurrently with the apparatus during fabrication. In the alternative, at least one self-adhering and/or adhesive layer means may be applied, first, to the apparatus optionally followed by the application of one or more substrate means formed releasable cover means. The severations in alignment with each desired separable line of the apparatus member to allow complete separation of the selected apparatus members. The releasable cover means may be applied as a single or multiple optionally intermittently severed substrate means tape-like form or individually applied to the required adhesive occupied portions. As a note, the attaching (affixing) means area portion consists of at least one attaching means area and, at least one attaching means area is originally covered with at least one releasable covering means.

The separably removable and mountable directory is occupied substantially on each face by the information means area. At least one face of the directory member has at least one inscribable entry area portion overlying thereon, each of at least one inscribable entry area portion having at least one cooperating inscribable entry area identified by at least one adjacent identification means indicia. The identification indicia employed may be variated to differentiate unrelated entry areas from one another and groups of "like" identification indicia from each other. The directory is provided with at least one inscribable enty area in which to place hand-written reference notations of "general" interest, for later review, i.e., articles, titles, songs, etc. The corresponding "cross-matched" markers may have an entry area to identify more specific and brief notes, i.e., columns numbers, paragraphs and line numbers, etc. In the alternative, the directory may be provided on at least one face of at least one marker (the primary marker is preferred for this purpose) or apparatus substrate if desired. The apparatus may also include subordinate (secondary) markers, if elected to be used, which may correspond to the corresponding directory identification indicia being specific to and adjacent to at least one inscribable entry area. Optionally, at least one information means area of each apparatus member may be adapted to receive/accept machine means (mechanically, electronically, electrically) readable indicia means thereon.

The apparatus may consist of at least one marker which may accompany a publication depending on its type and/or function. In the case of an individual plastic dust cover container for a compact disc publication, only a single marker may be required containing a machine readable identification indicia, such as a bar-code, for inventory purposes. First, the apparatus is removed by the recipient-user from the product packaging and/or publication vessel means and then mounted to a desired/preferred position on an outside margin of the dust-cover container with the marker head portion, as a preferred location for bearing the code indicia as opposed to the body portion of each marker member to bear the code, to extend beyond the physical edge of the dust cover container. A series of publications of a similar physical dimension may be stored juxtaposed in file in an equally uniform manner for later indexing and retrieval. Each container having a marker being informationally representative of and identifying a certain publication vessel, and each marker extending outward therefrom in systematic arrangement series such as staggered, consecutive, random or any other suitable pattern employed. This provides easy accessibility to the previously filed or misfiled publications at a glance or for instance, using a laser wand to readily scan each bar-code extending therefrom without having to remove each publication individually from its filed position. The laser wand is connected to a computer which in turn brings up the cataloged or "to be cataloged" information screen for identifying the publication which is then capable of being printed out. It is with the present invention that retrieval of various publication information is expedited and inventory control maintained.

The information means area which occupies substantially one face of each double-faced apparatus members may include advertising, trademarks, service marks, slogans, information, directions on "how-to", prize winning games, etc. including indentification indicia having many forms. One advantage is that the at least one indicia employed maybe of visually and/or combination of machine readable type—mechanically, magnetically, electically or otherwise. The information can be arranged with endless formats and layout designs at the descretion of the designer of the apparatus, taylor-made suitable for the appropriate need.

The apparatus may be made as a premium item/advertising specialty or as a stationary product, packaged in various quantities, for the user to purchase to "retro-index" back issues of publications requiring the reference-aid system of the present invention.

One object of the present invention is the provision of a publication reference-aid/marker apparatus system as a "production-assembled" product for temporarily securement with a publication means article during use and/or during time or manufacture of the publication, the apparatus comprising a remote and optionally mountable directory member and/or at least one marker member, the apparatus being formed from multi-faced substrate or substrates of the same or different kind by at least one separation line means as inserts, supplement means, or sheet stock membering the publication, each apparatus member face comprising optionally at least one information receiving means area, wherein at least one face having at least one attaching means area in abutment thereto and/or overlying such at least one information receiving means area being covered by at least one adhesive layer means being originally covered by at least one releasable cover means being disengageable from such at least one adhesive layer beneath, the marker mounting to the outside margin or desired area means of the publication means optionally extending beyond and overlying the edge, a separably removable and mountable directory for mounting the directory on the publication means optionally remote from the marker mounted to the same and/or different publication means, at least one face of the at least one directory having the information means area and the inscribable entry area portion overlying thereon having the information receiving means area having at least one attaching means area in abutment to and/or overlying such information receiving means area, at least one attaching means area portion occupied/covered by at least one adhesive layer means having the exposing surface layer being originally covered by at least one release cover means sheet and/or substrate overlying such at least one adhesive layer beneath; the apparatus use and system designed to facilitate a organized and standard means of the accessing, relocating and retrieving information contained in publication means vessels upon user actuated demand.

Another object of this invention is the provision of a publication reference-aid system apparatus wherein at least one apparatus member is constructed from at least one sheet/substrate means, wherein at least one separation line means forms the apparatus from at least one substrate means, wherein at least one apparatus member/marker member may be temporarily secured to at least one publication vessel during use or may be temporarily secured to at least one publication during manufacture prior to removal therefrom and mountable use on a publication vessel by a user.

A further object of this invention is the provision of a publication reference-aid marker member/marker panel portion which may be hingedly connected and/or articulated to at least one support panel substrate which may be at least one removably protective substrate carrying at least one marker thereon, wherein one face of each of the at least one marker member further comprises at least one attaching means area having self-adhering means and/or releasable and/or reusable pressure sensitive adhesive being the exposing layer of the adhesive layer means, by temporarily, semi-temporarily, semi-permanently and/or permanently, directly or indirectly attached thereto, wherein such attaching means area of the one face being adhesively releasably engaged to such support panel substrate to cover originally such attaching means area prior to removal therefrom and further being generally parallel thereto in generally face-to-face temporary contact relationship to each other.

Still another object of this invention is the provision of a publication reference-aid system apparatus wherein each adhesive layer means is at least one of substantially transparent, substantially translucent and substantially opaque, and wherein each adhesive layer may be adapted to accept colorization and/or color tint or color opacity.

Another object of the present invention is the provision of a publication reference-aid system apparatus wherein at least one releasable cover means may be intermittently severed to form and/or allow complete separation of each selected apparatus member with its respective release cover or covers, wherein at least one edge of the releasable cover means may optionally extend beyond the at least one adhesive layer beneath to facilitate removal of such releasable cover means from such adhesive layer means prior to use.

Another further object of the present invention is the provision of a publication reference-aid system/marker apparatus wherein the protective releasable cover substrate means is at least one of the same substrate and different substrate and is at least one of independent (non-articulated) to the each apparatus member and/or hingedly connected (articulated) being folded over along a foldable line means to originally engage and releasably adjoin the at least one exposing surface layer of such at least one adhesive layer means.

A further object of the present invention is the provision of a publication reference-aid system apparatus wherein such at least one releasable cover substrate means is or may become multi-faced and optionally adapted to receive information means thereon at least one face thereof; wherein such release cover means is at least one of flexible, semi-flexible, semi-rigid and rigid in substrate construction; wherein at least one release cover means substrate being of the same or different substrate or substrates is optionally free from use of supplemental repellant release coating means and/or impregnation means applied to the substrate on at least one face thereof or in the alternative, optionally free from such repellant absorbed into the substrate or into at least one face thereof and still facilitates adhesive releasable means which distinguishes the unique features of the subject invention from prior art.

Still a further object of the present invention is the provision of a publication reference-aid system apparatus wherein at least one attaching means area occupies at least one face of each apparatus member; wherein the sum total attaching means area or areas is from about 2% to about 99.9% of the information receiving means area of each marker's face, or apparatus' face; wherein such attaching means area(s) is adhesively imaged.

Still another further object of the present invention is the provision of a publication reference-aid system apparatus wherein each face of the remote directory portion is substantially occupied by at least one information receiving means area which may include optionally at least one inscribable entry area thereon; wherein at least one face further comprises at least one attaching means area portion being in abutment to, spaced from and/or overlying such at least one information receiving means area, wherein such at least one attaching means area being occupied/covered by at least one adhesive layer means further being covered by at least one releasable cover means.

Another further object of the present invention is the provision of a publication reference-aid system apparatus wherein optionally at least one face of each apparatus member is comprised of at least one inscribable entry area, wherein optionally at least one information means code identifies at least one inscribable entry area being representative thereof and/or being adjacent thereto and/or specific thereto.

Yet a further object of the present invention is the provision of a publication reference-aid system apparatus wherein at least two "like" identification means codes are mutually corresponding to each other; wherein "like" identification means codes are reciprocally corresponding in determined/pre-determined associative relationship with each other, wherein sets comprising at least two codes per set are representative of identification means indicia being variated to differentiate groups of "like" identification means indicia from each other.

Still yet a further object of this invention is the provision of a publication reference-aid system apparatus wherein the information means area is comprised of at least one inscribable entry area portion, wherein at least one information means area of the apparatus is adapted to accept machine readable identification means indicia.

Still yet another further object of this invention is the provision of a publication reference-aid system apparatus wherein the "production-assembled" apparatus is an improvement for publications and an improvement over prior index systems as a reference-aid apparatus for paginated and non-paginated publications such as periodicals, compact and floppy discs, music record albums, cassette tapes of all types and other manufactured publications of variety which are collected and stored enhancing the usability of the publication means.

Yet still a further object of the present invention is the provision of a publication reference-aid system apparatus wherein the reference marker apparatus is at least one of at least one reference and/or placement marker member means, at least one game marker means and at least one adheringly releasable coupon means; each of which may utilize at least one scent means and/or palate means optionally as a supplemental integration means to the substrate being surface coating means and/or inpregnation means to at least one substrate.

Thus, the present invention is directed at a reference-aid/marker system which is designed such that it may have supplementation means to the publication means vessel from being internally disposed, externally disposed, articulated therewith and/or non-articulated or combination thereof providing a convenient and easily accessible reference-aid for rapidly retrieving and accessing and/or relocating paginated and/or non-paginated publication information upon demand. Thus, the present invention has as one object the provision that the reference-aid/marker member system in and of itself is a publication means vessel or such reference-aid/marker system is supplied with a publication means vessel and issued therewith being separable removable therefrom and mountable and/or remountable to at least one one publication surface/border margin by at least one attaching means area portion on at least one face thereof; wherein each of at least one adhesive layer means may be at least one of non-aggressive, moderately aggressive and aggressive and combinations thereof in the adhesion range depending upon the designer at will and intent to combine adhesive layers as desired for the apparatus. The exposing surface layer from which the releasable cover means is removable prior to marker means use may be disengagable from at least one publication surface at least once and/or in the alternative, remountable on at least one publication surface at least once or remountable enumerable times in the function of each apparatus component member. Each reference-aid marker member or members may be constructed from a marker panel portion being defined/formed therefrom by at least one separation line means (continuous or interrupted) from the same substrate and/or different substrate as the publication vessel means or in another form be integrally defined as a gang contiguous or separated from each other. Each marker member/apparatus member may be unitarily formed from the marker panel portion and/or independently formed from the same substrate or substrates and/or different substrate or substrates. Each adhesive layer means material substance is comprised of a water base substance/formula or solvent base substance/formula being commercially or non-commercially available and further an optical flexible, semi-flexible, semi-rigid and rigid base liner means may be sandwiched therebetween such at least two adhesive layers. Further, at least one base liner means may be utilized as desired and may be from the group consisting of substantially transparent, substantially translucent and substantially opaque.

The reference-aid of the present invention may be of an independent substrate or substrates of the same or different type including any of its associated component or components directly or indirectly relating thereto. The same concepts apply to the release cover means wherein at least one releasable cover means may be a support and/or retaining panel portion articulated and/or non-articulated to each reference-aid component member or members. formed from at least one of the same or different substrate means as the publication vessel means and/or at least one reference-aid apparatus member. Such at least one releasable cover means may be intrasected to be releasable along with its respective apparatus member or members. The substrates employed for the reference-aid apparatus and/or components thereof may further carry at least one scent (olfactory) means thereon (e.g. fragrance scent, odiferous scent, aromatic scent means) or in the alternative at least one flavor burst to taste. The apparatus substrate or substrates may be free of any anti-stick coating means on the surface and/or absored by or within the substrate means and still render the releasable cover means effective and purposeful in application due to the preferred adhesive properties employed. The releasable cover means preferred peeling forces shall not exceed the bonding strength of two or more adhesive layers sandwiched and/or at least one adhesive layer means to the substrate means and such adhesive layer means shall be at least sufficient to at least hold selected apparatus member or members to a publication surface in application prior to discarding thereof.

These and other objects and advantages of the present invention are apparent or shall become apparent in the disclosure and will be best understood in the following detailed description, drawing and claims.

DETAILED DESCRIPTION OF THE DRAWINGS

Figure 1:
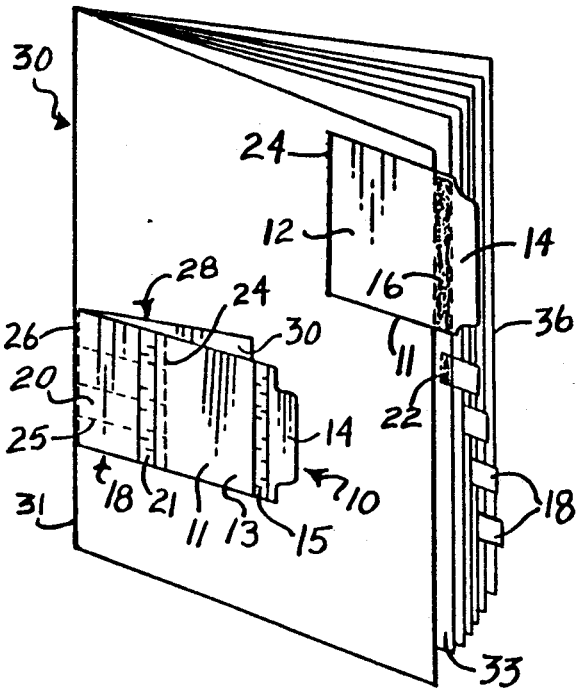
FIG. 1 is a perspective view of a paginated publication type showing the separably removable and mountable apparatus temporarily secured as a convenient reference-aid therewith, the primary and secondary markers having been removed and mounted to the selected pages.
Figure 2:
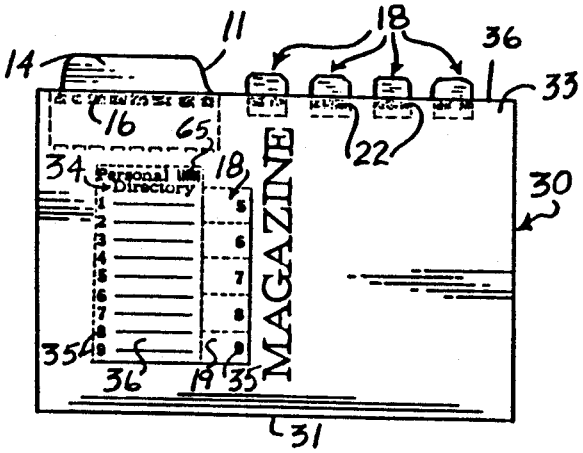
FIG. 2 is an elevational view of the publication type shown in FIG. 1, showing the apparatus members separated and mounted to a publication, prepared for file.
Figure 16:
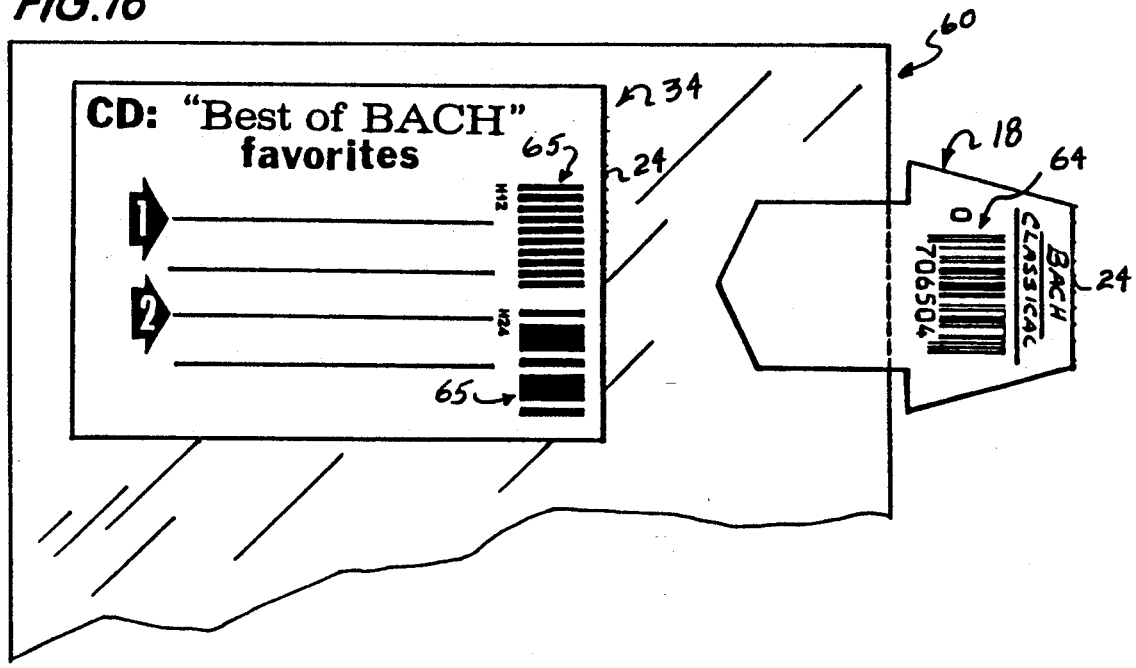
FIG. 16 is a fragmentary plan view of a compact disc dust-cover container showing one assigned marker to identify the publication in use; at least one machine readable identification indicia; and, the marker having a modified geometric shape.
Figure 17:
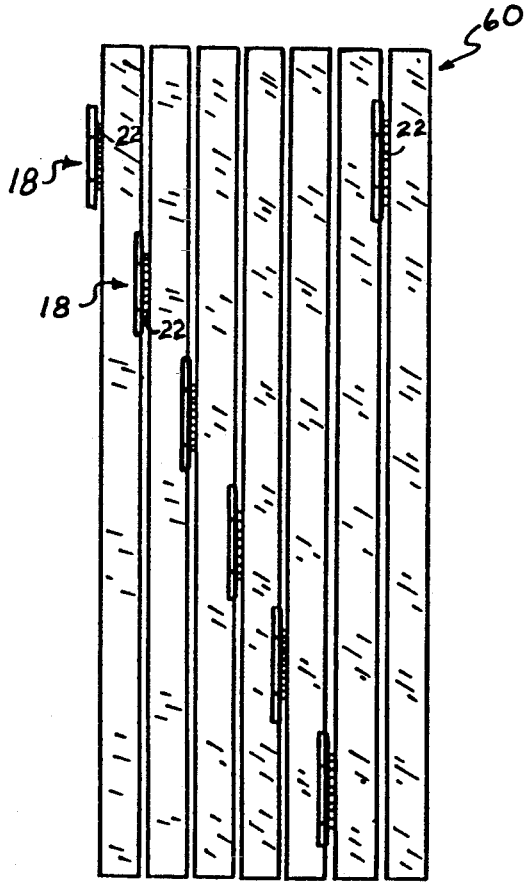
FIG. 17 shows a preferred embodiment of the markers in series arranged in consecutive placement pattern to inventory and retrieve the publication of FIG. 16 when filed juxtaposed in a storage receptacle.

In accordance with this invention, a separably removable reference-aid apparatus 10 assembled with a publication 30 at the time of manufacture, the publication being of various types—paginated and non-paginated—for example, a magazine periodical 30 shown in FIGS. 1 and 2; the compact disc container 60, viewed in FIGS. 16 and 17. The reference-aid apparatus 10 is constructed from multiple-faced substrate means stock material which may be of paper, mylar, plastic, vinyl or any material suitable for this intended use. Further, at least one apparatus member is constructed from at least one sheet of material by at least one separation line means 24, 25, 26 employed to form the apparatus from the sheet of material. As illustrated in several views, FIGS. 3, 10, 11, 12, 14 and 16, the sheet may be divided into one or more apparatus members, depending upon application and design; by at least one separation line means, shown to be 24, 25, 26, for example.

Figure 3:
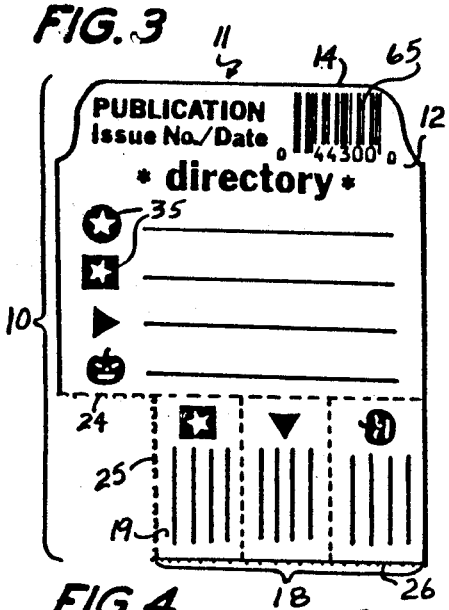
FIG. 3 is a plan view of the reference-aid apparatus showing a secondary marker removed from separable lines.
Figure 4:
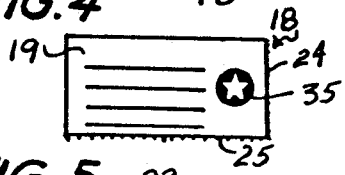
FIG. 4 is a plan view of one face of the index marker detached from the parent reference-aid apparatus of FIG. 3.

FIG. 3 shows basically an embodiment of one apparatus arrangement having one member element separably removed from the parent apparatus. In this embodiment, the apparatus 10 optionally consists of the primary marker member element 11 having a file head tab 14 specifically designed for publication information, and optionally, machine readable identification means indicia 65, etc. Both faces 12 and 13 of the primary marker being occupied substantially by at least one information means area which may be used to incorporate an imaged/imprinted directory on at least one face (the face with and/or without the adhesive.) As can be seen, the information means area is comprised of at least one inscribable entry area portion, and the inscribable entry area portion is comprised of at least one inscribable entry area where each cooperating inscribable entry area is identified at least one adjacent identification means indicia 35. Further, each adjacent cooperating identification means indicia 35 corresponds to a "like" identification indicia shown to be below on one face 19 of the subordinate (secondary) markers 18 separably removable from the parent sheet by lines 24 and 25. The secondary markers also have the information means area occupying substantially both faces 19 and 20. Such at least one adjacent cooperating identification means indicia may be variated to distinguish at least one entry area from another. Also, matched sets of identification means indicia comprise at least two "like" identification means indicia which reciprocally correspond in "cross-matched" cooperation with each other. Each of the matched sets of two or more identification means indicia being variated to differentiate groups of "like" identification means indicia from each other.

Figure 8:
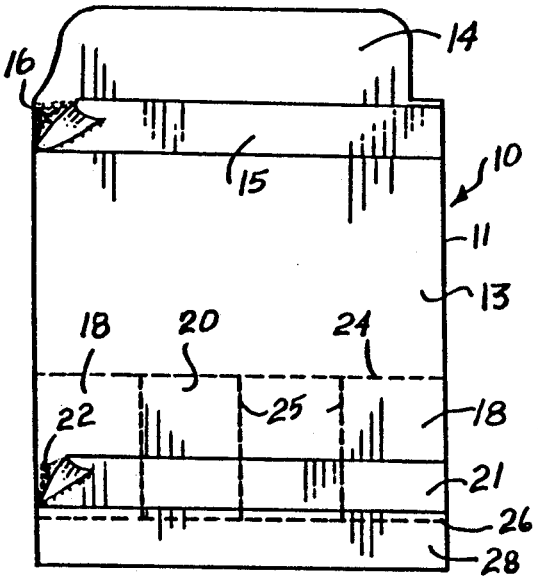
FIG. 8 is an elevational view of the opposite one face of the reference-aid apparatus showing the releasable protective covering means partially peeled away, further illustrating an example of a modification "lip" extension connected by a separable line means to the parent sheet.

FIG. 8 illustrates the opposite one face of the apparatus arrangement in FIG. 3 having a "lip" portion 28 temporarily secured to the apparatus 10 by a separable line 26. This at least one face 13,20 of each of the apparatus members is occupied substantially by the information means area on which at least one attaching means area portion occupied by adhesive 16 and 22 overlies the information means area. Such at least one attaching means area may be less than or greater than or equal to one-half of the marker depending upon the designer involved. Further, the attaching means area portion is comprised of at least one attaching means area, for example, which may be decorated with adhesive graphic images, perhaps in a pattern. Regardless of the number of attaching areas employed, the sum total of the attaching means area is from about 2% to about 99.9% of the information means area on at least one face of the apparatus member. In addition, at least one attaching means area is overlayed with the releasable covering means. The releasably protective covering means 15, 21 multiple-faced and optionally intermittently severed to allow complete separation of the apparatus members permitting individual removal from non-selected members. At least one edge of the protective covering 15 and 21 optionally extends beyond the layer adhesive 16 and 22 beneath to facilitate removal of the covering means from the adhesive means, shown in FIGS. 3, 8 and 13. The protective covering means may be decorated by being adapted to be imaged/imprinted on at least one face of the substrate.

Figure 9:
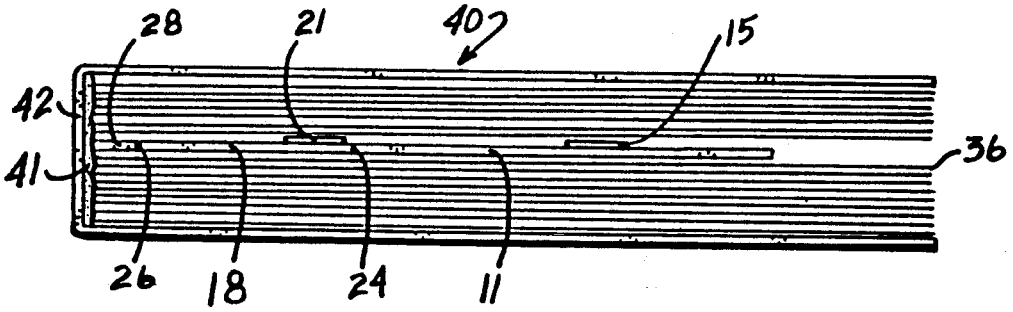
FIG. 9 is a top plan view of a perfect bound publication type with the apparatus of FIG. 8 temporarily secured therein.

FIGS. 1 and 9 illustrate the apparatus collated with a paginated publication means as a supplemented insert being temporarily secured within, ready for distribution to the user who will separably remove and mount the desired apparatus members to the publication means as an aid to later access and retrieve the publication information. FIG. 1 shows the apparatus temporarily secured to the spine area 31 of a saddle-stitched publication 30; FIG. 9 further shows the apparatus perfectly bound (glued-in) by the "lip" portion 28 fixated with glue 41 permanently to the spine portion 42 of the publication (paginated type); Both FIGS. 1 and 9 illustrating the apparatus separably removable from at least one separation line means 24,25, and 26.

Figure 10:
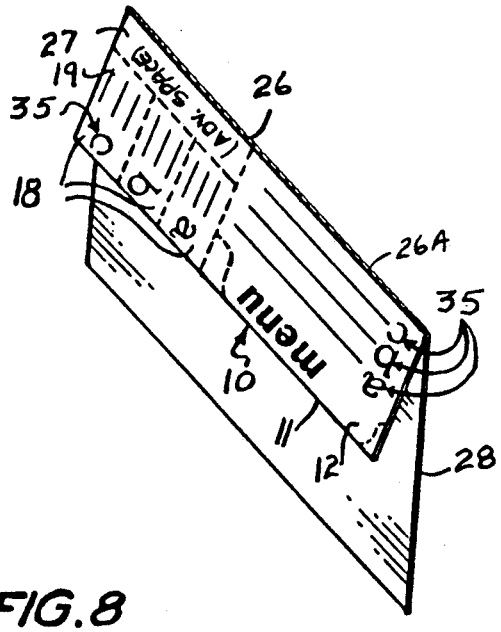
FIG. 10 is another perspective view showing an insert supplement sheet incorporating the apparatus as an alternate embodiment, the apparatus separably removable from a "hanger" panel portion.
Figure 11:
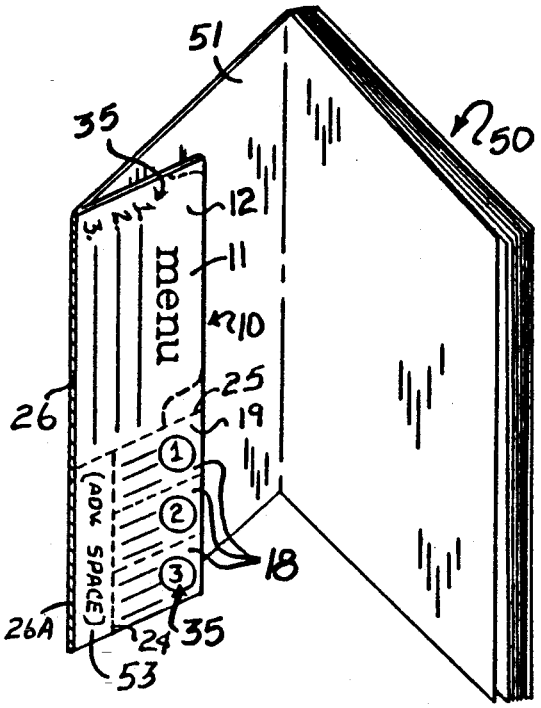
FIG. 11 is still another perspective view of a paginated publication showing the apparatus as an integral part of a gate fold panel being separably removable therefrom illustrating another embodiment.

The embodiments shown in FIGS. 10, 11, 12 and 14 illustrate other arrangements of the apparatus members as well as selections of the desired apparatus members to be employed. For example, FIG. 10 shows a variated arrangement of the apparatus being constructed from a "hanger-like" panel portion 27 of a sheet 28 separably removable along separable lines 24, 25, 26, etc. FIG. 11 shows a similar panel portion to that of FIG. 10 with the apparatus 10 formed as a part of the gate fold panel portion 53 of a panel leaf 51 permanently secured to a paginated publication 50, the apparatus being temporarily secured and separably removable by separable line 24, 25, 26. In the alternative, the apparatus 10 shown in FIGS. 3 and 8 for example, may be disposed inwardly between the adjacent pages as a form of securement. Further, the apparatus may lie between the pages to be adhesively secured temporarily (a page substituting for a protective covering means)—thus SAVING a manufacturing operation. In the case of a non-paginated publication, the apparatus, such as the one shown in FIG. 16 may be enclosed freely with the publication/packaging or perhaps formed from a supplement sheet included within.

Figure 12:
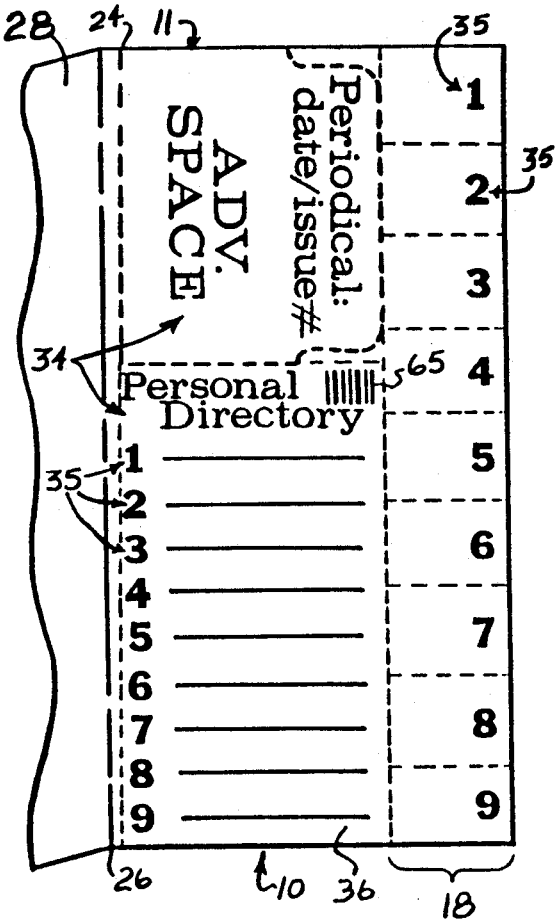
FIGS. 12 and 13 show front and rear views of the apparatus arranged in different format, illustrating the removably mountable directory remote from the marker members.
Figure 14:
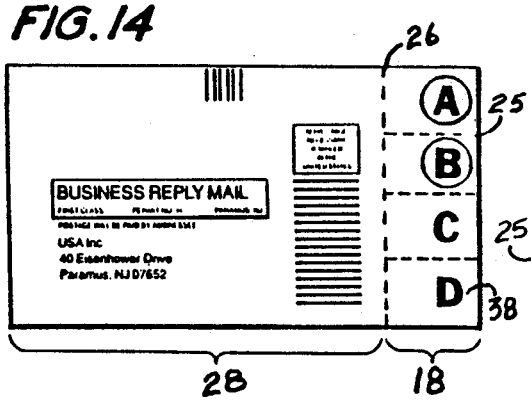
FIGS. 14 and 15 show front and rear views of at least one marker separably removable by at least one separable line means from an insert supplement.
Figure 15:
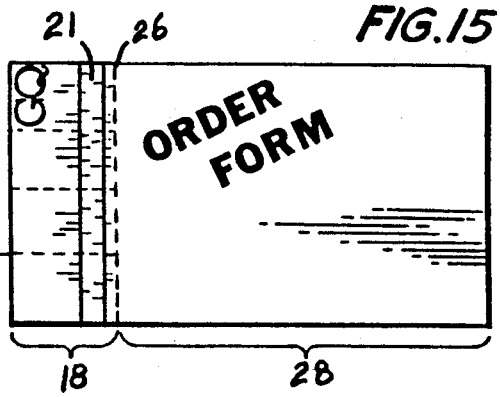

The primary and secondary markers 11 and 18, respectively, may be used in cooperation with each other as shown in FIG. 3 or be in cooperation with a separably mountable directory 34 viewed in FIG. 12 or be "non-cooperating" indicia 38, FIG. 14, to one another by the selected identification means indicia employed. It is an option, with the present invention, that at least one information means area of an apparatus member employed have at least one identification means indicia, FIG. 15, i.e., to indicate the publication and/or an advertising logo 65 sponsor, bar/color-code indicia, trademark, legend, etc.

For practical purposes, the apparatus members used in practice may be substantially rectangular configurations or perhaps substantially geometrical, as seen in FIGS. 3, 12, 14; modified geometrical shapes as seen in FIGS. 2 and 16; or irregular shapes, like animated characters and the like which may also be employed depending upon user market. The size of the mountable directory and the markers may vary substantially. The marker may have, for example, dimensions of length and width of 1½ inches by 7/8 inch or vise versa or any other suitable shape or dimension. The designer may choose to have a fraction of the marker extend beyond and overlie the edge of the publication; should this occur the attaching means area portion on the opposite face might need to overlie approximately 95% of the information means area which substantially occupies the one face, as an example.

In the case of the non-paginated publication variety, at least one marker may be required to accompany the manufactured publication, as shown in FIG. 16, which may be assigned to identify the particular publication using bar codes 64,65 trademarks, etc. and/or perhaps an inscribable entry area provided, if desired, to indicate the compact disc selection, music record album, cassette tape, diskette to be reviewed. Even with this variation shown, the designer may warrant the employment of at least one information means area of apparatus to be adapted to accept machine readable indentification means indicia, being read either magnetically, electrically, electronically, by scannable means or otherwise.

Should any one or all the apparatus members be made as a production assembled unit, independently or unitarily formed and/or incorporated with a publication means vessel (paginated or non-paginated) each apparatus member may be capable of being at least temporarily mountable to a publication or temporarily secured with a publication vessel during transit and/or distribution to be separably removable from the publication means and mountable thereto by a user.

Figure 34:
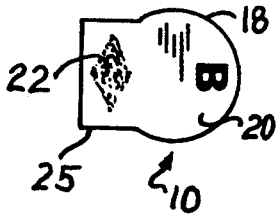
FIG. 34 is an elevational plan view of the reverse face of the double-faced marker member showing the adhesive image positioned on the attaching (affixing) means area portion of the marker member.
Figure 36:
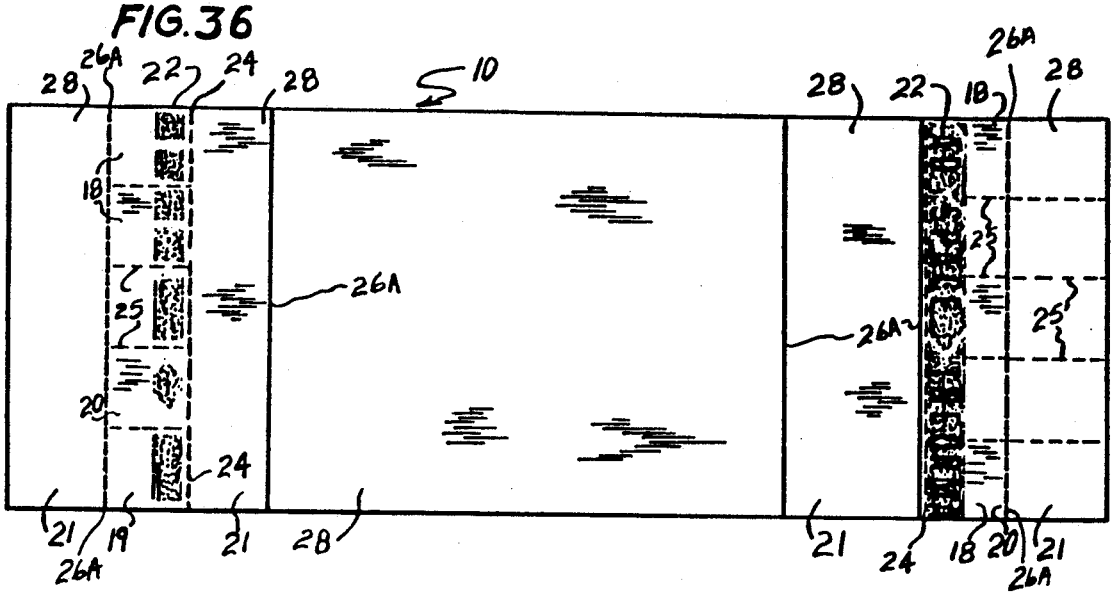
FIG. 36 is an elevational plan view of a book cover jacket incorporating the marker panel portions being each detachably connecting from an associated releasable cover panel portion each meeting at the outer respective edge of each marker panel portion.

The apparatus incorporates the use at least one adhesive layer, each being at least one of substantially transparent, substantially translucent and substantially opaque adhesive layer means which occupies/covers at least one attaching means area portion of at least one face of the multi-face substrate from which such reference apparatus is formed. Each of at least one adhesive layer means employed may be optionally patterned/-shaped to appear at least one of substantially geometrically, substantially modified-geometrically and irregularly and further may optionally lie substantially perpendicular, substantially transversely and/or randomly across the face of each apparatus member. As can be seen in FIGS. 34, 36 the adhesive layer means may form decorative adhesive graphic images. The at least one attaching means area may be at least one of contiguous with the information means area, spaced from the at least one information means area and/or commonly shared with least one information means area, depending upon the designer at will. The at least one attaching means area and/or the at least one information means area comprise substantially at least one face of each apparatus member. Each marker member may be adheringly mounted to a border margin and/or substrate surface of a publication; the directory adheringly mountable to a publication vessel's surface where desired. The co-existing aforementioned areas comprising at least one face of each marker member and directory portion (not shown). Thus an improvement over prior art, now providing greater versatility and flexibility in application and layout/format design. For instance, advertising may be imaged on at least one face of the selected apparatus member or members and may further lie beneath at least one adhesive layer means on the support liner 22C, FIG. 24 and/or on the substrate means FIGS. 13, 36. depending upon the designer's intent. Due to the fact that the advertising space is increased (which includes the information means area beneath the substantially transparent and/or substantially translucent adhesive occupying the attaching means area portion) the additional possibilities that may result are "unexpected" from a creative standpoint and are broadened substantially by the mere aspect of this inherent feature.

Figure 13:
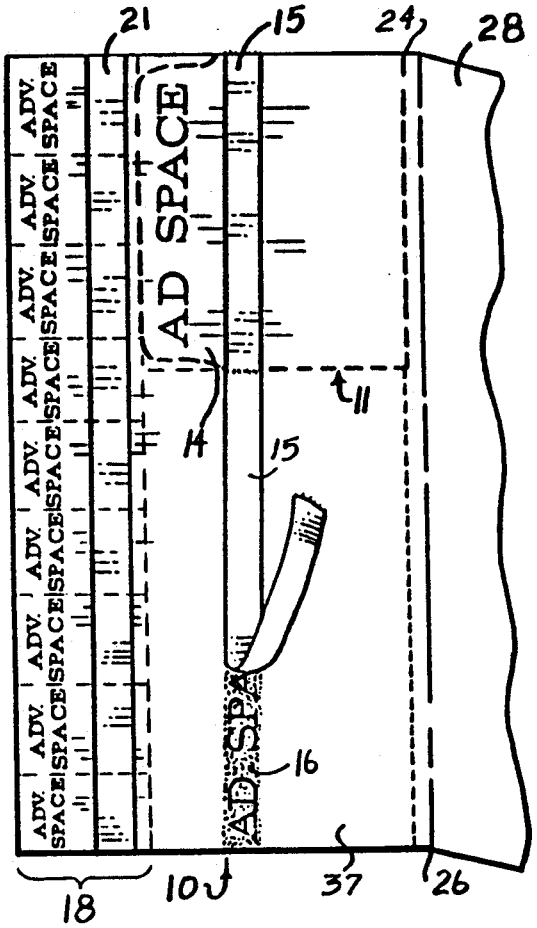

The optionally intermittently severed protective covering 15, 21 (without a release coating means and/or impregnated adhesive repellant means) as shown in FIGS. 8 and 13 is adapted to be imaged/imprinted on at least one face and optionally at least one edge of the covering means extends beyond the adhesive beneath to facilitate removal of the covering means 15 and 21 from the adhesive substance 16 and 22. Further, a number of coverings may be employed, taking on various shapes, i.e., circles, stars, squares or any other shape and may be individually applied to at least one attaching means area occupied by adhesive, illustrated in FIG. 20.

Figure 6:
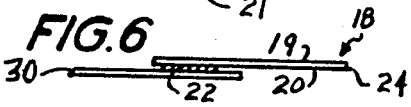
FIG. 6 is a fragmentary edge view of the index marker of FIG. 5 mounted to the outside margin of a publication, extending beyond and overlying the edge thereof.
Figure 7:
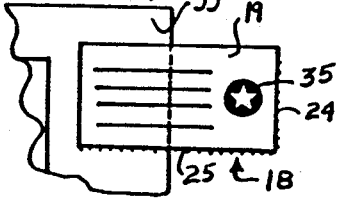
FIG. 7 is a fragmentary plan view showing an apparatus marker adhesively mounted to the outside margin of a publication, showing the "cross-matched" identification indicia adjacent the inscribable entry area comprising the entry area portion which overlies the information means area substantially occupying one face.

Before, during and/or after optional separation of the desired apparatus members 11,18, and/or 34, the at least one protective covering means is removed from the apparatus 10 exposing the surface adhesive layer thereunder and optionally revealing information means readable images through such suitable adhesive layer, as imaged/imprinted on and/or to at least one apparatus/-marker member substrate as illustrated in FIG. 13. The apparatus is separably removable from its parent substrate/publication, if necessary or individually produced (including its at least one protective releasable covering, if desired). The protective covering removed and the index apparatus is mounted to the outside margin of the desired publication for which it was selected and/or from whence it came, the marker portion extending beyond and overlying the edge as can be seen in FIGS. 6, 7 and 16. Should a lottery game, for example, be employed with the apparatus members, the protective releasable coverings 16 and 21 (which may be substantially opaque in this variation) may conceal the numbers beneath the releasable covering 21 and/or the at least one adhesive layer means and/or the optional adhesive carrier base liner 22C. Depending upon application, the protective covering substrate means may be peeled away to reveal information means such as games, advertising and other suitable readable images. The designer may like to use a substantially transparent, substantially translucent, substantially opaque releasably protective covering means or combinations thereof, as an alternative, to create the desired effect.

Once the apparatus/marker member or members are adheringly mounted or remounted appropriately to their parent and/or desired publication for which such apparatus and/or at least one marker member was selected and/or from whence they (it) came, they provide simplicity and ease when re-locating and/or inventorying numerous publications of a particular type that are placed juxtaposed in storage. FIG. 17 illustrates a series of markers in consecutive arrangement identifying each compact disc selection without having to remove each publication, unnecessarily, from its filed position in storage for visual and/or machine and/or electronic reading purposes.

Figure 5:
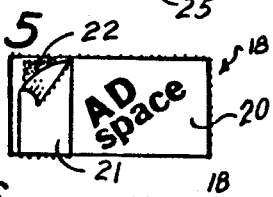
FIG. 5 is a plan view of the opposite one face of the page index marker in FIG. 4, showing the releasable protective covering means partially peeled away exposing the adhesive means beneath occupying the attaching means area portion which overlies the information means area.
Figures 18, 19, 20:
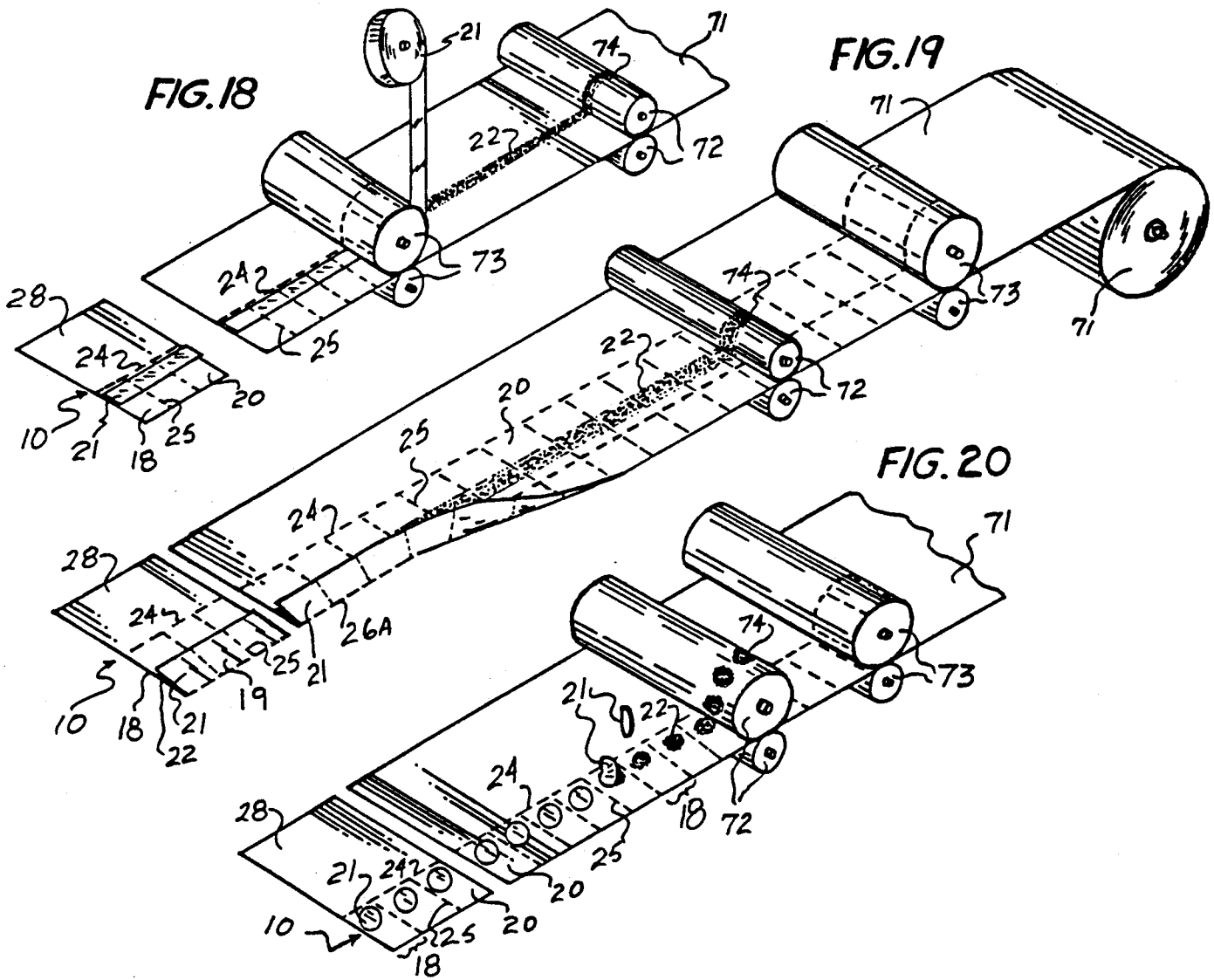
FIG. 18, 19, 20, 21, 22, 23 and 24 are generally schematic, perspective views illustrating possible production methods and reference-aid apparatus.

The protective covering means may be applied to the apparatus/marker members whereby both elements maybe severed and/or perforated, die cut and the like concurrently during the fabrication process shown in FIG. 18. In the alternative, the releasably protective covering means 21 may be applied following fabrication of the apparatus from the substrate/sheet stock, the protective releasable covering means then being optionally intermittently severed before, during or after application (possibly by a programmable tape dispenser) to correspond with the pre-existing separable lines on the substrate/sheet in approximate alignment therewith, permitting complete separation and individual selection of the individual apparatus members and their adjoined (articulated) respective releasable protective covering, shown in FIG. 5, with the covering means partially removed exposing the adhesive beneath. Cmployment of the optionally intermittently severed releasably protective covering means may not only be beneficial to allow complete separation of the selected apparatus member or members, it also eliminates the need to tear of rip the removable covering substrate/sheet during individual member separation as well as providing a means to separate each fabricated apparatus entity from another during the operation of manufacturing when the releasable covering sheet means is being applied, if desired.

In another production method, the releasably protective covering substrate/sheet 15,21 may be integrally formed from and hingedly connected to substrate/-material being intentionally untreated and/or treated (entirely or partially) with adhesive repellant substance; the apparatus 10 having such release covering means integrally formed therewith being folded over along the foldable line means 26A to releasably adjoin the exterior surface adhesive layer of the at least one adhesive layer means 16,22 to facilitate the engagement and application of the releasable protective covering means thereby eliminating the need for a separate protective covering to be applied to the apparatus face illustrated in FIG. 19 (demonstrating "in-line" production)

Figure 21:
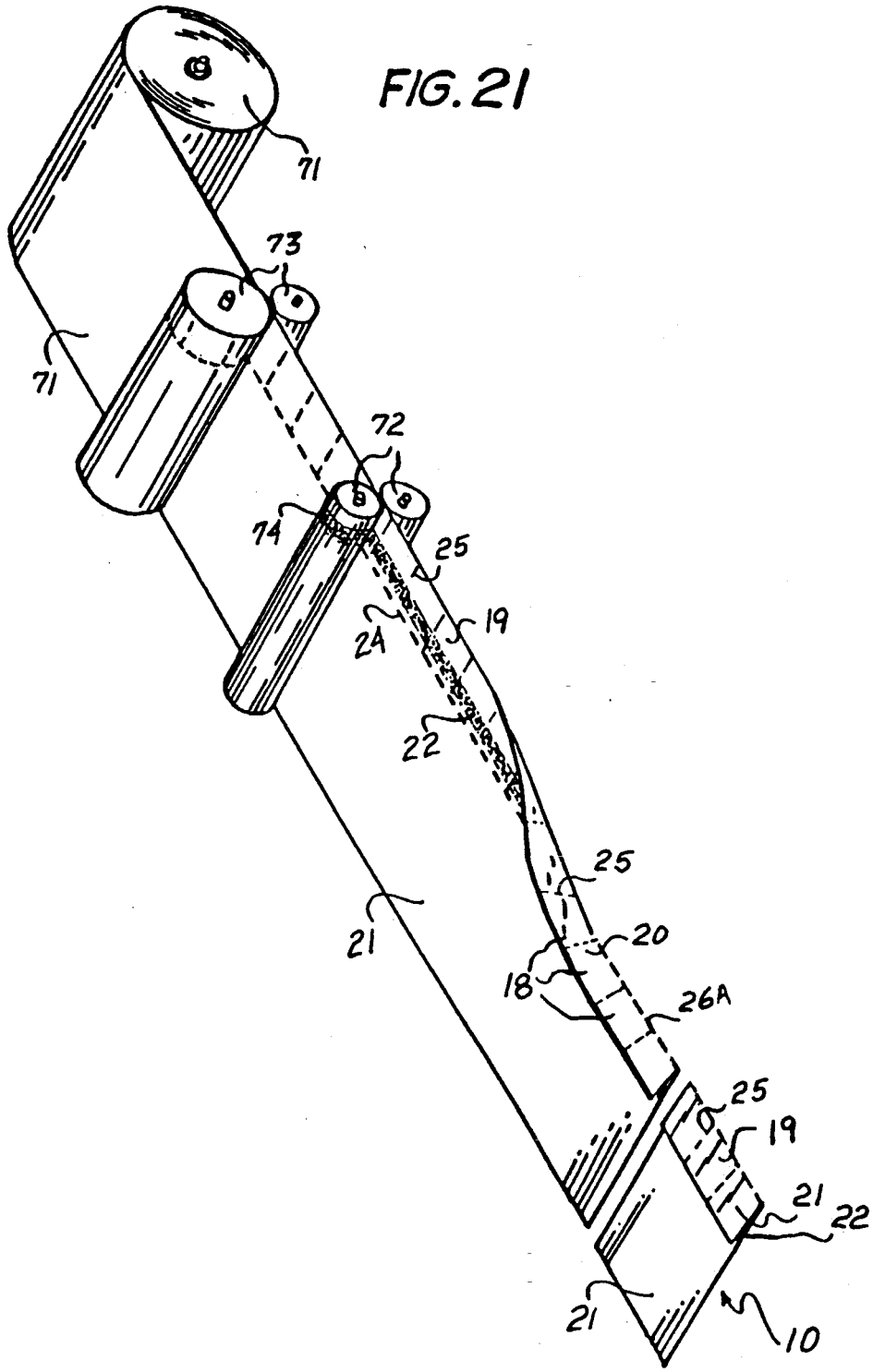

The apparatus of this invention can be economically mass produced by optionally passing the sheet material 71 from a roll or sheet substrate (sheet fed) through at least one imaging operation station which may perform, entirely or partially, such imaging function in the fabrication of the apparatus as either a single operation or concurrently with another function operation at the same station. The multi-performed function technique (not shown) may be said for each station in the process of manufacture of the reference-aid apparatus. FIGS. 19 and 21 demonstrate examples of high volume "in-line" methods of manufacture and of adjoining the releasably protective covering means 21 hingedly connected (articulated by a fold line means) to the sheet stock material 71 from which the reference-aid apparatus is formed. From the substrate means 71, the apparatus 10 is formed by separation line means/line means 24, 25, 26, for example, between the press rollers 73 at one station. At the next station of operation, at least one adhesive layer means 22 is applied as an adhesive image 74 by mechanical apparatus (e.g. press rollers, etc.) to the attaching (affixing) means area or areas of the apparatus 10. In this example, in the engaging step, the release cover means 21 is folded over such at least one adhesive layer and/or at least one attaching means area on each member and/or the entire apparatus 10 to cover and protect such exterior/exposing adhesive layer surface until use; the apparatus and release covering may each be separable from each other and/or from the substrate means 71. Optionally, the apparatus 10 may be supplemented with a publication vessel means or be issued/distributed as its own publication vessel means following the forming step which separates and/or trims at least one reference-article apparatus from the optional parent substrate means to at least one determined/predetermined dimension. FIG. 21 shows an alternate method of fabrication, where the apparatus 10 after such at least one adhesive layer means is applied over at least one attaching means area thereon, the apparatus shown here as a gang of markers 18 being folded over along the foldable line means 26A onto the hingedly connected and intentionally untreated and/or treated release cover means 21 of the substrate means 71.

It is possible, that either the apparatus marker(s) 11, 18 and/or the intentionally untreated and/or treated release cover means 21 may be unitarily formed together from the same substrate or different substrates, if desired, and that each component may be formed/defined by at least one separation line means.

Another method of production designed for "off-line" (shorter) production runs would be by applying-/attaching at least one adhesive layer means 22 (in this example) by press rollers 72 to at least one attaching means area of at least one face of the apparatus 10. FIG. 18 illustrates at least one release cover means 21 being applied from roll form being further segmented by the station (shown to be press rollers 73) integrally forming the apparatus and concurrently intrasecting the release cover means 21 by at least one separation line means. In FIG. 20 the sheet material (substrate means 71) is shown to pass through press rollers 73 which integrally forms the apparatus 10, (showing members 18 only); the sheet continuing to pass through the second station between what is shown as press rollers 72 which apply at least one adhesive layer means substance 22 to the attaching means area of the substrate means (being indicated by circular-shaped adhesive image layer); the optionally intermittently severed release coverings 21 formed by at least one separation line means, 24, 25, 26 are independently and/or unitarily adjoined/engaged to the exterior surface layer of the adhesive layer means 22. The final step shown, for example, to form and/or trim the apparatus 10 to a least one determined/pre-determined dimension for supplementation means with a publication vessel and/or distribution as a self-publication vessel means apparatus 10.

In use of this invention, a method of employing this reference aid/marker means apparatus for use with at least one paginated and/or non-paginated vessel means to relocate, reference placement, retrieve and/or access information and/or positioning thereon. The reference apparatus may act to serve as an index marker, game marker means, coupon marker means, reference placement marker and/or combinations thereof. For instance, a game marker member may identify by marking a certain place or places of movement across a game board substrate/graphic layout substrate receiving means.

In utilizing the apparatus/marker member or members, comprising the steps of: (a) optionally separably removing the production-assembled apparatus from each other and/or from the publication vessel means from which it was issued therewith and/or temporarily secured thereto being distributed therewith; (b) optionally further separating other selected apparatus members and/or members to be employed on at least one publication vessel substrate; (c) optionally hand writing/imaging information on the information means areas provided; (d) peeling away selected protective release cover substrate or substrates from each marker member or members; (e) mounting the selected apparatus member or members to the border margin of a publication adjacent the edge thereof and/or to at least one publication substrate surface; (f) optionally cross-matching apparatus members and/or directory matching information areas having a predetermined mutually corresponding associative relationship to each other; (g) means for reading the information means area or areas carrying certain information which is adapted to be read via machine means, electronically, magnetically, electrically and/or scannable/visual readable information means or combinations thereof. Modifications may be possible as well as sequential order of process variated without departure herefrom.

In this manner of function, inventory control capabilities may be employed along with ease in identifying certain publication vessels through the use of fewer hand motions required to relocate desired publication material which is to be found by utilizing readable information of a variety of types.

The improved reference-aid offers additional novel and unobvious features distinguishable from prior art as well as "unexpected" information area or areas which may be employed thereunder the adhesive layer means, on the carrier/support liner 22C or on the at least one release cover means 21. The newly identified advertising/message area portion or portions are to be exploited by designers of the apparatus thus providing advantages to publishers, advertising sponsors, and users of the apparatus as a promotional tool/premium item.

The present invention enhances the usefulness of publications and is practical as well as complementary to the function of both "index listings" and "table of contents", if provided, depending on the type of publication which includes the apparatus. The included apparatus with a publication vessel during apparatus application and/or during manufacturing, increases the "informational value" of the publication vessel product to a user.

In further contemplation of the foregoing reference-aid publication supplement, alternate variations in design and manufacture are discovered in view of accomplishing the same reference-aid/article product which may be externally supplied with a publication; internally included/supplied within the confines of the publication or perhaps even a combination of external/internal supplementation means as provided by the apparatus when formed as a book cover substrate or slip-on jacket as illustrated in FIGS. 30, 32, 35, 37 and 38.

Referring to the additional drawings FIGS. 22 to 38, further, at least one multi-faced substrate means being substantially flexible, substantially semi-flexible, substantially semi-rigid and substantially rigid from which at least one reference-aid/article 10 is formed by at least one separation line means 24,25,26; such apparatus having at least one determined/predetermined dimension size and being capable of accepting/receiving visible and/or invisibly readable information means on at least one face or optionally impregnated into said at least one substrate means, as an "in-line" or "off-line" product produced by modern imaging technology and machinery. It will be understood that the reference-aid/marker product 10 may be produced one-up (individually) or ganged from the sheet during manufacture, then processed to at least one determined/predetermined dimension for distribution/supplementation means with and/or as at least one publication vessel means prior to distribution. The reference-aid may be produced in blank (unimaged) form without bearing information on either face or the substrate means may be adapted to receive/accept information means thereon one or both faces 19, 20 thereof, e.g. illustrations, advertising means including all forms of machine and/or electronically readable recognition formats being at least one of mechanically readable, electronically readable, electrically readable, image scannably readable or and other readable code means for this intended use.

Figure 25:
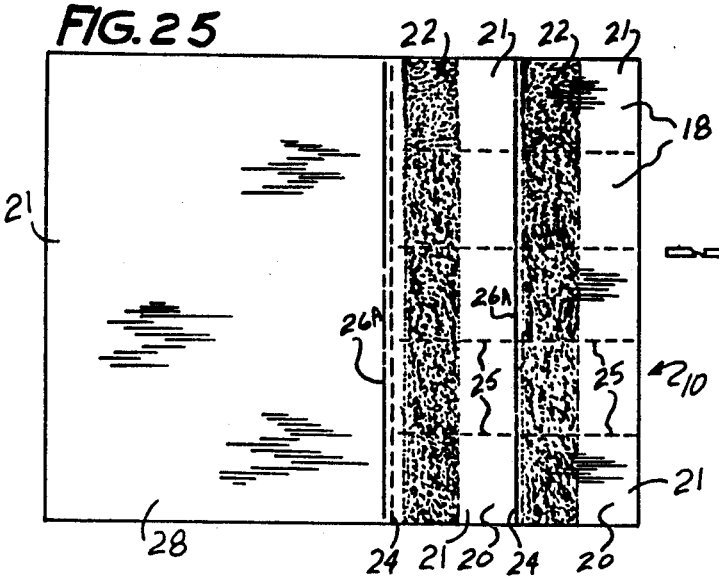
FIGS. 25 and 26 are plan views of the reference-aid of the invention showing possible variations of the marker panel portion, the adhesive positioning thereon and associated releasable coverings.
Figure 27:
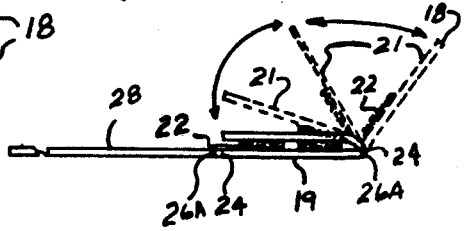
FIGS. 27 and 28 are side views of FIGS. 25 and 26, respectively, showing the hingedly connected panel portion engaged and disengaged in the direction of the arrows, tightly creased along the foldable line.
Figure 26:
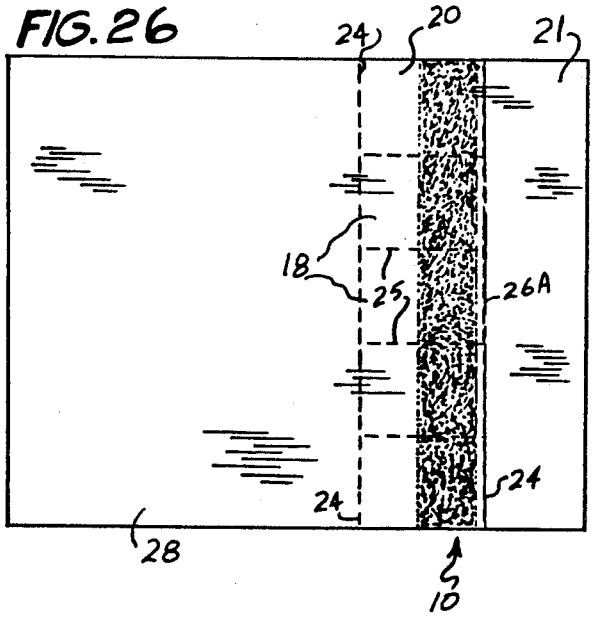
Figure 28:
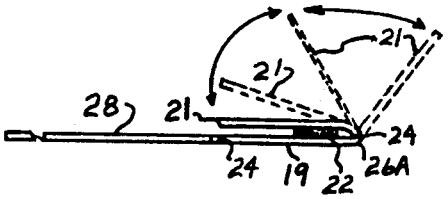

The reference-aid 10 made in the prudent and least expensive "in-line" method of manufacture, FIGS. 25 and 26, illustrates the substrate means of multi-faced material (flexible, semi-flexible, semi-rigid, rigid) having at least one determined/predetermined dimension size for supplementation and/or distribution means with or without a publication vessel means (paginated or non-paginated). The reference-aid 10, including its removably protective cover means 21 substrate may be formed from the same reference-aid substrate as independent or unitarily formed elements or in the alternative, the reference-aid/marker apparatus and/or the associated removably protective cover means may be formed from independently or unitarily fabricated different substrates.

At least one separation line means 24,25,26 essentially forms at least one marker member (primary and/or secondary) and/or the directory portion (not shown) which may be from a marker panel portion of the at least one substrate means; the remainder of the substrate being an optional support panel/retaining panel 28/releasable cover panel 21 or combination to secure each individual marker member 18 or a gang of markers thereto, until such an apparatus has been distributed as a publication vessel or issued with a publication vessel means and activated by a user. As can be seen in FIGS. 25 and 26, the marker panel portion which serves to define and/or confine the area from which each marker member or members are formed, is is optionally articulated and/or hingedly connected to the support panel 28 portion depending upon the intent of the designer. The marker panel portion 18, from which at least one marker/apparatus member is formed by at least one separably continuous and/or interrupted line means, being folded over along a foldable line means 26A to engage originally the at least one attaching means area(s) having at least one adhesive layer means 22, wherein the exposing/mounting surface layer may be a releasable and reusable adhesive layer means or just releasable adhesive layer means or optionally, permanent adhesive layer means, for instance, in the use of at least one primary marker member having the file head tab to identify a publication vessel in practice. Such at least one adhesive layer means being at least one of temporarily, semi-temporarily, semi-permanent or permanently applied to the substrate of each apparatus member. The removably protective substrate 21 being generally parallel to the marker member or members and/or the at least one attaching means area/exposing surface layer means thereunder such release covering 21 being in generally face-to-face temporary contact relationship with each other, shown in FIGS. 27, 28. The substrate is being folded and firmly creased along the foldable line means 26A to originally engage and cover the at least one adhesive layer means 22 substance(s) of the marker member or members and/or apparatus members. The engaging faces, as shown, of the marker panel portion/marker member 18 and the articulated contact support panel 28, acting as the releasable cover means 21, are deemed to be the cooperating inner face of each such element which are capable of engaging and disengaging at least once or enumerable times in use, due to the variety of adhesive types (i.e. pressure sensitive adhesive, etc.) employed with the present invention. It is to be understood that the preferred type of adhesive to be employed in practice is a releasable and/or reusable pressure sensitive and/or self-adhering adhesive layer in order to preserve the publication from damage when such markers are releasably removed from the surface of a publication vessel means, border margin, cover, page, etc. Further, it is to be noted that such preferred adhesive layer means will not leave harmful residues as a remainderment on the publication vessel upon removal or re-removal of each marker and/or apparatus member therefrom, should the same marker/apparatus member be needed to be used in another location on the same or different publication substrate surface.

The foldable line means may be an independent line spaced from the line of separations or be employed as the same or "common" shared line 26A which would then optionally extend substantially entirely the length of the substrate to form the marker panel portion 18 and its adjoining releasable cover means 21 being articulated (hingedly connected) directly to the marker member(s)/marker panel portion or indirectly to the support panel portion 28 as an option. In an alternate method of manufacture, the foldable line means may be additionally slit/severed by separation line means before, during or after the folding operational step, causing the apparatus component members (e.g. releasable cover means) to become an independent releasable cover panel portion 21 being, of course, constructed from the same intentionally untreated substrate sheet comprising the apparatus; the present invention being unique, novel and unobvious with respect to its features/characteristics thereby being distinguishable from the prior art.

Figure 46:
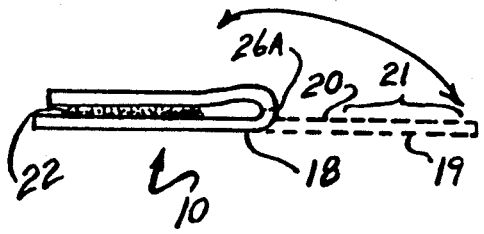
FIG. 46 is a side view of FIG. 5, showing a variated embodiment illustrating the non-adhesive portion of the marker folded over onto the exposing adhesive layer acting and substituting for a protective release cover means substrate means; and, FIG. 47 is a perspective view of two exemplary multi-dimensional reference/game/coupon markers releasably temporarily mounted to a substrate (game board) with one version showing a single stack of two markers adheringly mounted in application.

The apparatus marker member or members may be formed from at least one marker panel portion 18 (which in itself may be construed as one large marker member, if desired) by at least one separation line means 24,25, 26 which may be used to segment by intrasection, each marker member therefrom such panel portion. Each line of separation employed may distinguish by isolating and/or unitarily forming at least one marker from the marker panel portion 18. FIG. 26, shows in this example, such separation line to extend substantially across the marker panel portion. The same intrasecting separation line means may continue across the releasable protective cover member 21 permitting individual and complete separation and removal of the selected marker 18 and its associated releasable protective cover sheet 21 shown to hingedly connected therewith. In another version, as seen in FIG. 25, the removable protective cover substrate 21 may also carry at least one adhesive layer means which may permit such release cover substrate to also be a marker panel portion 18 from which at least one marker/apparatus member is formed—the placement of the attaching means area is in alternating position to permit alternating engagement of the non-adhesive portions of each marker panel portion 18 as shown. Numeral 26A illustrates at least one foldable line means to manifest an optional foldable line whereby both marker panel portions are folded onto support release cover substrate 28/21. The marker panel portions/marker members may be layer individually, accordian folded and/or coiled or even folded onto themselves as seen in FIG. 46. It is important to note, that the adhesive area(s) of the marker member may correspondingly engage and disengage with non-adhesive area(s) of other marker/apparatus member or members acting as release covers themselves. Depending upon the adhesive layer means employed, it may be suitable that adhesive layer means of the same or different apparatus member or members engage and disengage as an alternative release cover means. The embodiment in FIG. 25 shows cooperating and optionally adjacent panel portions, each portion being a marker panel 18, to be adhesively releasably engaged to the non-adhesive surface of the other in generally face-to-face temporary contact relationship until use. Each marker panel portion 18 is shown, in this example, to be articulated to one another along a foldable line means 26A as an option. However, in the alternative, such marker panel portions may be spaced from one another by the use of a support panel portion positioned therebetween as an option. The foldable line may be a common "shared" line meaning as it is both a separation line means and a foldable line, or may be exclusively independent from the separation line means and spaced therefrom. FIG. 25, illustrates two marker panel portions 18 hingedly connected along at least one respective edges of each thereof, in this variated embodiment. As another variation, each marker/apparatus member may be formed individually by at least one separation line means 24,25,26 from the interior area confines of the marker panel portion; each marker having a shape/outline determined by at least one separation line means which is used to form each apparatus/marker member. The separation line means used to define and shape each marker member 18 may be a continuous or interrupted severed line such as a die cut line, perforation line, indented/weakened line, tear line, or otherwise to separably remove each selected marker/apparatus member from the substrate means. The "separated" line may also be in the form of an "image" line to represent the outline to manually cut-out such apparatus/marker members, perhaps with a scissors.

In FIGS. 25 and 27, and FIGS. 26 and 28, the panel portions 18 and 21, respectively, are shown to be folded inwardly and over onto the articulated substrate along at least one foldable line means 26A, as indicated by the direction of the arrows. This operation originally engages the releasable and/or reusable adhesive layer means 22 of the marker panel portion/marker member 18 with an other marker panel portion FIG. 25 or with at least one support substrate acting to serve the function of a releasable cover substrate 21 as in FIG. 26. It is important to further note that the removably protective sheet (substrate) 21 employed with the present invention is uniquely distinguishable from the prior art whereby is can be of the same or different substrate from which the reference-aid 10 is made, and further such selected substrate may not essentially require a special adhesive repellant treatment or any other anti-stick coating substance to be applied to the substrate or one which impregnates the substrate—an uncoated vellum bristol stock, index stock, for example, is suitably appropriate as is an emamel/coated finished stock, in an alternative example. In either examples mentioned of suitable stock, note that neither substrates are intentionally treated with a adhesive repellant means in order to be suitable in practice with the present invention for engaging and disengaging purposes when used with the releasable and reusable adhesive layer means. The elimination of requiring such an intentionally treated stock- /anti-stick specially produced release liner/coating means not only creates a savings from the aspect of the product manufacturing cost, but provides greater opportunities and advantages in terms of selection of kinds of stock (substrate(s)) to be utilized, and in product format design capabilities not disclosed in prior patent citings. The removably protective releasable cover means 21 may be created from the same stock as the marker/apparatus members or be a "foreign" substrate, different from the substrate from which at least one marker/apparatus is formed. A release cover substrate such as a page of a book, FIG. 33, or cover of a book FIG. 11; mylar strip, plastic, vinyl, polymer substrate means, etc.—in other words both the reference-aid apparatus member or members and releasable cover means substrate 21 may be of the same or different substrates and may utilize a treated and/or untreated substrate depending upon the designer at will.

Figure 22:
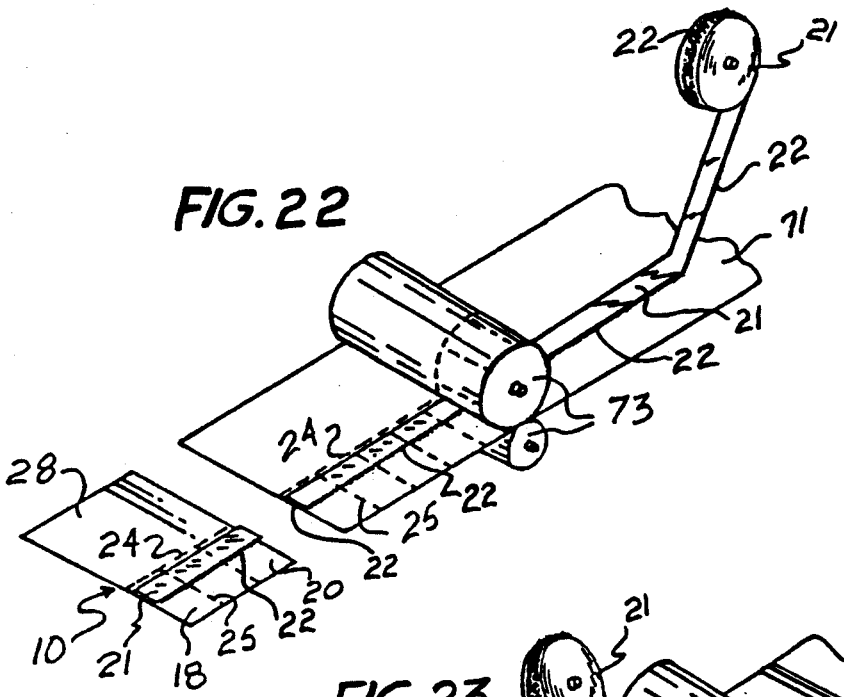
Figure 23:
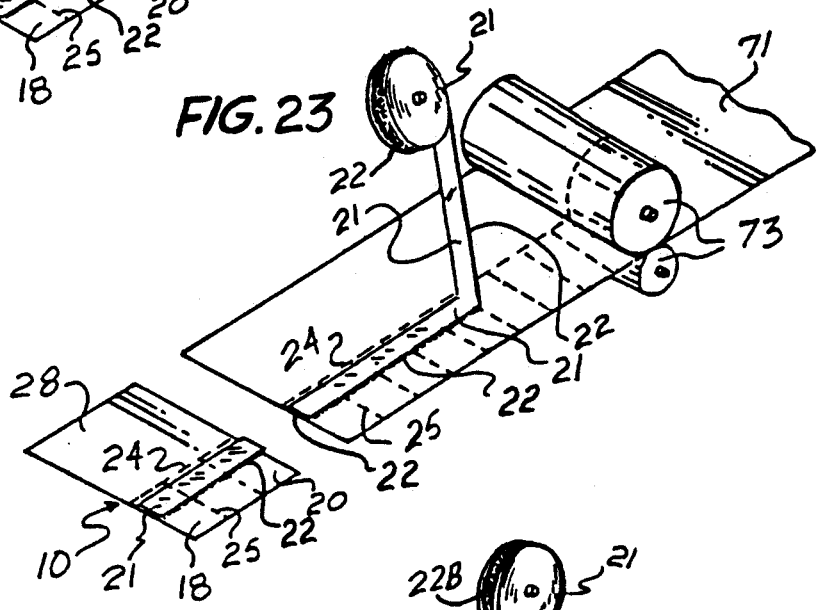
Figure 24:
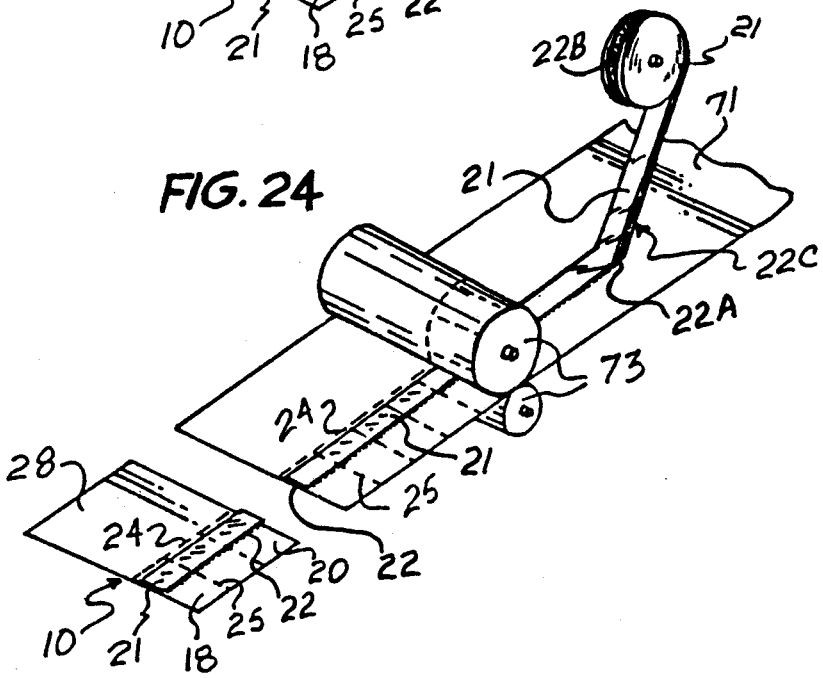

In another method of manufacture, a transfer/removably protective releasable cover means 21, as shown in FIGS. 22–23, transfers the adhesive layer means 22 onto the substrate 71; the at least one adhesive layer means 22 attached/applied by at least one of permanently, semi-permanently, semi-temporarily and temporarily to the at least one attaching means area of the at least one substrate means 71 prior to the removably protective substrate 21 being applied to cover the external exposing surface layer of the at least one releasable and/or reusable adhesive layer means 22 from the following methods: from rolled form, FIG. 18; individually attached, FIG. 20; by means of a fold-over flap means, FIGS. 19 and 21. FIG. 24 is unique in that it illustrates, from rolled form, the transfer releasable protective cover means 21 having a sandwiched carrier/support 22C layered therebetween at least two adhesive layers 22A, 22B; each adhesive layer being of differential adhesive bonding strength to the other or the same adhesive bonding strength upon application to the substrate means 71. The adhesive layer means which contacts the substrate 71 has securement means thereto such that the peeling forces of the releasable cover substrate means 21 may only minimally separate partial adhesive particulate upon removal from the adhesive layer thereunder, if at all which, of course, would be the most desirable case. The adhesive exposing/exterior layer surface, upon removal of the transfer cover means 21 reveals the releasable and/or reusable adhesive layer means 22 which may be a self-adhering and/or pressure sensitive adhesive, for instance, and may be carried by another adhesive layer or layers means of a multi-layered material; such multi-layered material may be reinforced and sandwiched by an optional base support liner/sub-carrier 22C. The support liner/sub-carrier may be flexible, semi-flexible, semi-rigid and/or rigid depending upon design and utility needs.

Figure 33:
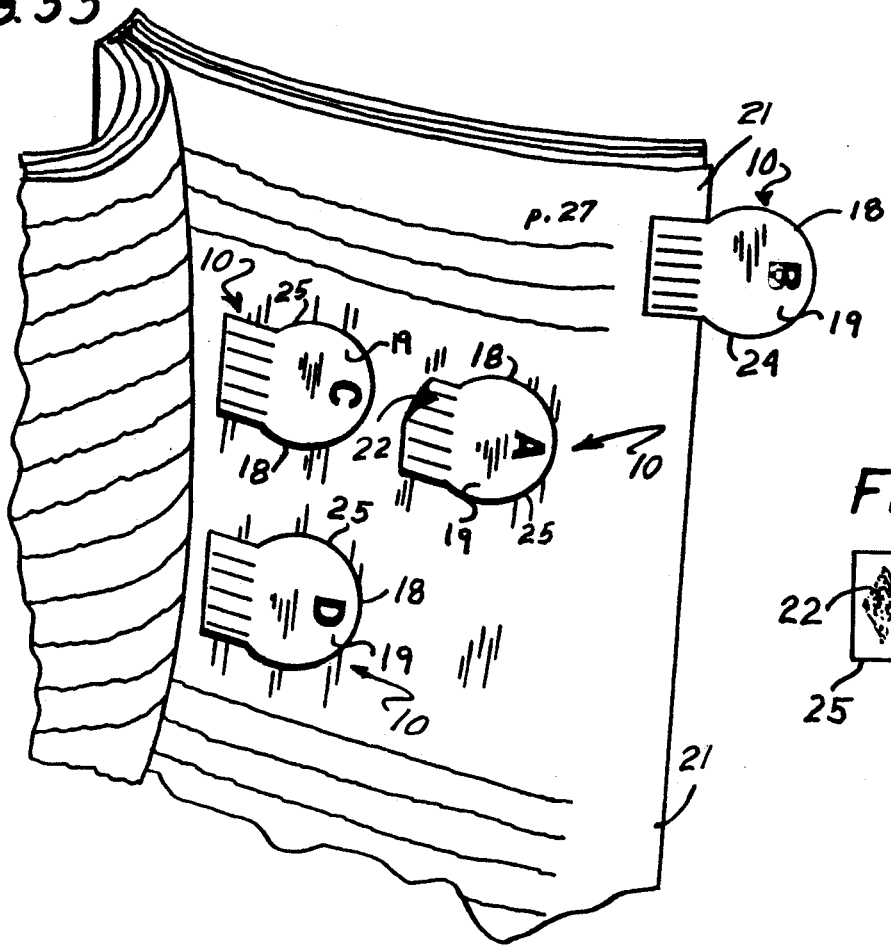
FIG. 33 is a pictorial view of the reference-aid of the invention in another variation, showing independent marker member means adheringly releasably attached-/engaged to an untreated "common" releasable cover substrate means being free from a repellant/release coating/impregnated substance means; such embodiment further illustrates a page of a book to uniquely act as a releasable cover means to retain and support the markers thereon.
Figure 44:
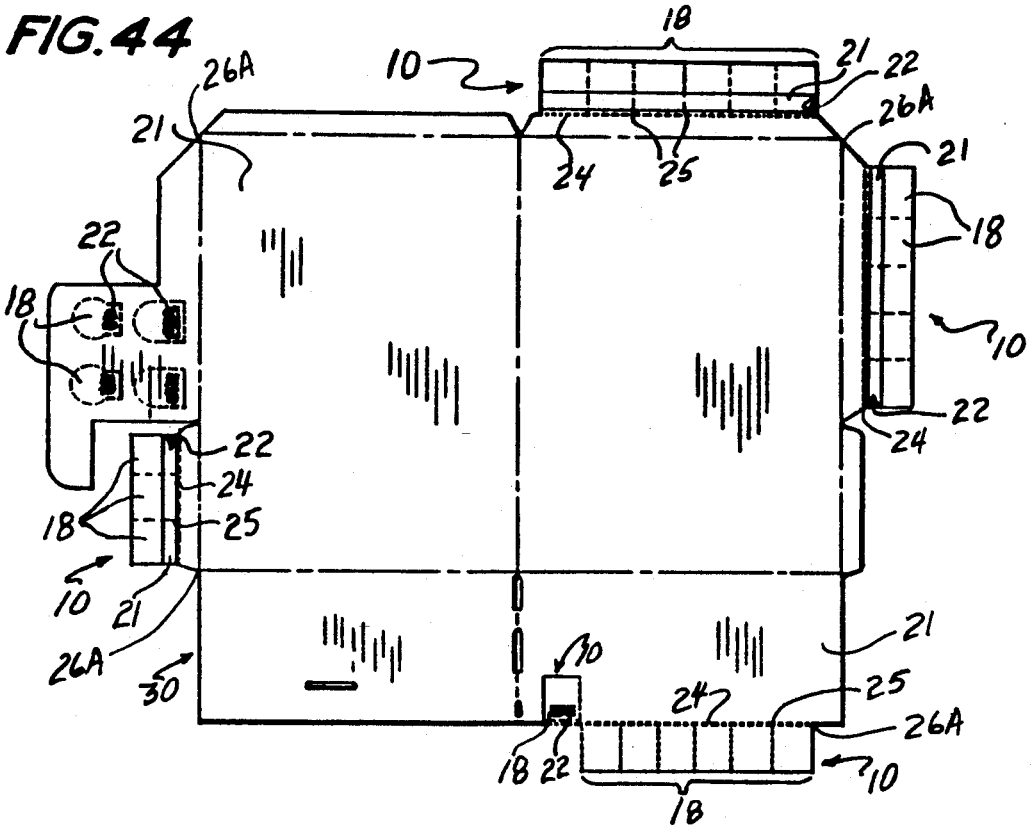
FIG. 44 is a plan view of a pocket portfolio publication article/vessel showing the adaptations of the reference-article as incorporated onto various member portions of such portfolio substrate.
Figure 45:
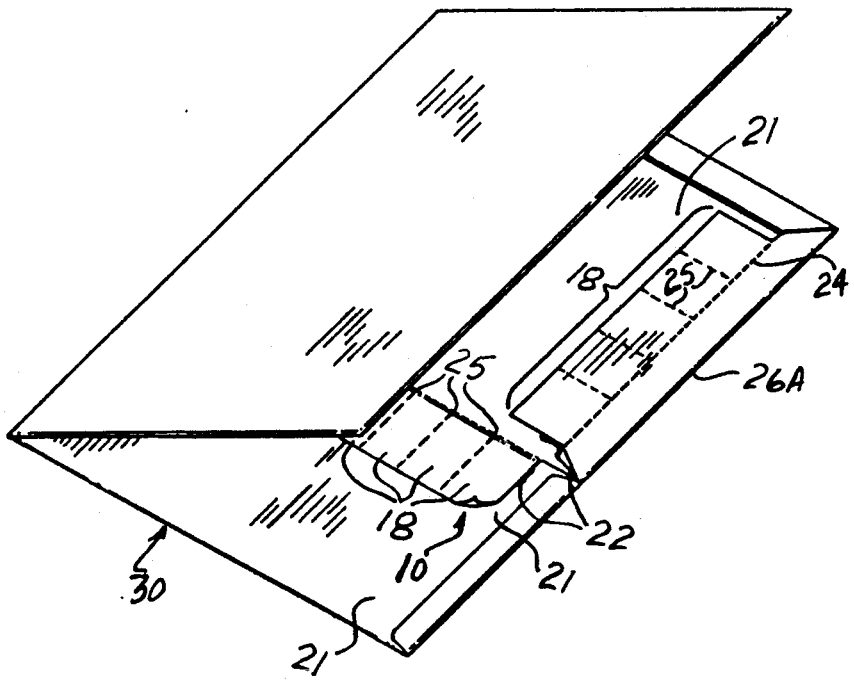
FIG. 45 is perspective view of the portfolio of FIG. 44 illustrating the article/vessel in an assembled construction with the reference article apparatus having been adapted as an integrally formed supplement device to the portfolio substrate. which is publication means vessel.

FIGS. 33 and 34, show pictorial illustrations of a releasable cover panel portion 21 acting as a retaining panel/support panel as a substrate (page) contained within the interior of a book; lying disposed between the pages thereof. The support panel may be a flexible substrate, semi-flexible substrate, semi-rigid substrate and/or rigid substrate means (e.g. hard cover book, etc.) which permits the markers A–D to be releasable and removable therefrom upon actuated demand by a user. FIG. 34 further manifests at least one attaching means area of marker member "B" having been releasably removed from the removably protective sheet substrate 21 and mounted to the border margin of a paginated publication 30 shown in FIG. 33. In this example, only one face 20 displays the attaching means area as a pattern in a diamond-like shape, as an example; the at least one attaching means area (only one shown in this example) is occupied/covered by the at least one adhesive layer means 22 allowing such adhesive layer means to be engaged and disengaged at least twice from an interacting substrate means, which may include the releasable cover substrate and/or a publication substrate means. It is important to note that the reference-aid 10 of the present invention has incorporation means with a publication vessel means (paginated and/or non-paginated types) and further may be issued with and/or as a publication vessel means in distribution thereof. FIGS. 3, 10, 12, 14, and 29–32, 35–38, show the reference-aid apparatus as a possible insert supplement, for disposing within the interior confines and/or with the exterior confines of a publication vessel means, business reply card and book jacket substrate, respectively. It is possible that the business reply card and book cover jacket be construed to be non-paginated publication vessels by conceptual definition for distribution means. The support panel portion 28 or portions utilized may be construed to mean a paginated and/or non-paginated publication vessel. Alternately, the reference-aid may be integrally/unitarity formed from part of a publication page, cover panel, FIG. 11; supplement such as an envelope, over-wrap, poly bag, or even folder or pocket folder, FIGS. 44, 45, and/or perhaps externally of the publication vessel means and/or externally of the covering means/enveloping means substrate, if desired to be issued and supplied therewith during distribution means. It can be assumed, that solely the publication reference-aid is deemed to be a publication vessel means.

Figure 39:
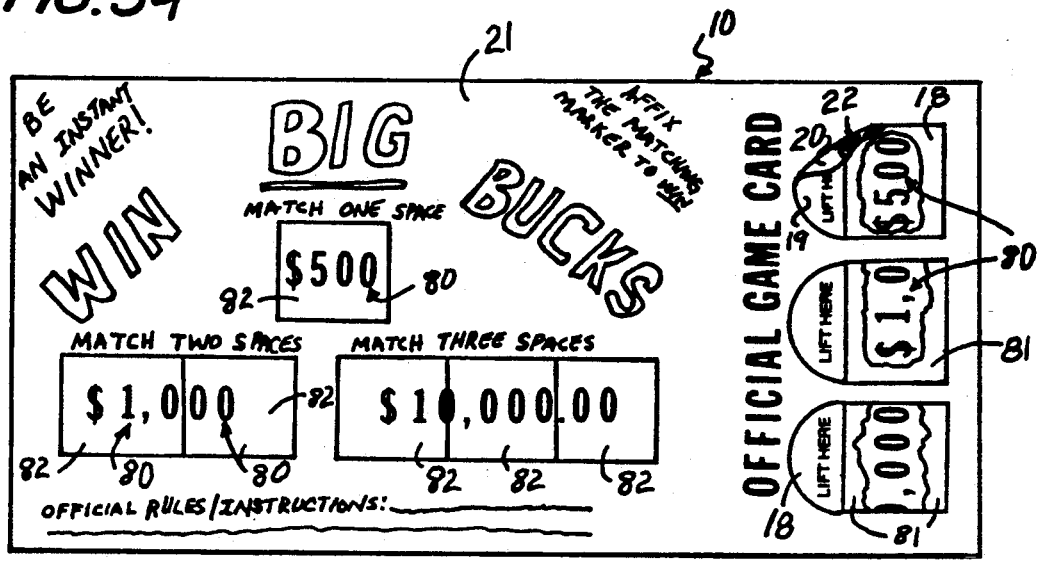
FIG. 39 is an elevational plan view of the reference-aid as a publication game supplement illustrating one game marker partially removed from its original engagement with the removably protective substrate means.
Figure 40:
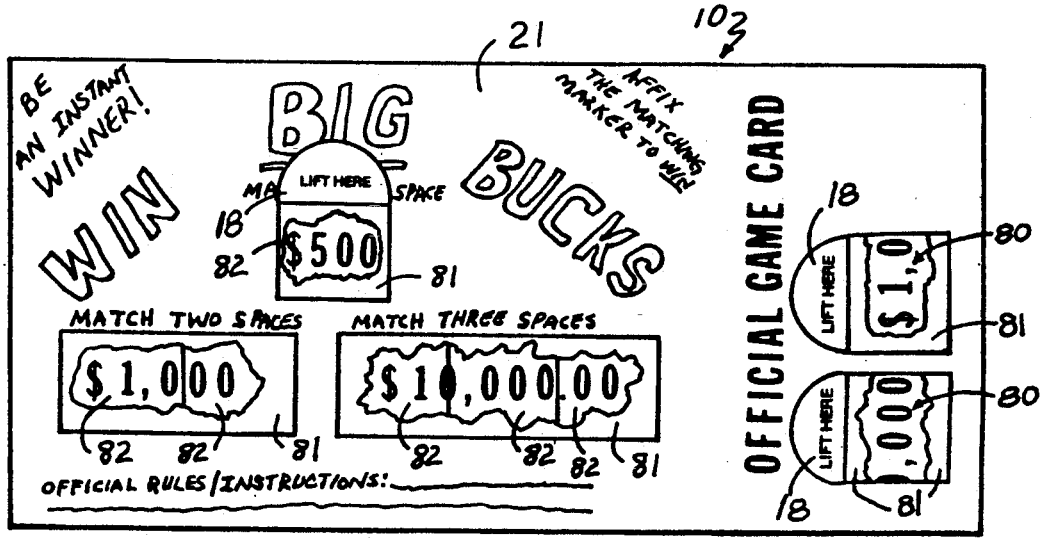
FIG. 40 is an elevational plan view similar to FIG. 39 showing the retaining support panel (game card substrate) with the matching game marker re-engaged thereon displaying the substantially opaque covering means removed.
Figure 47:
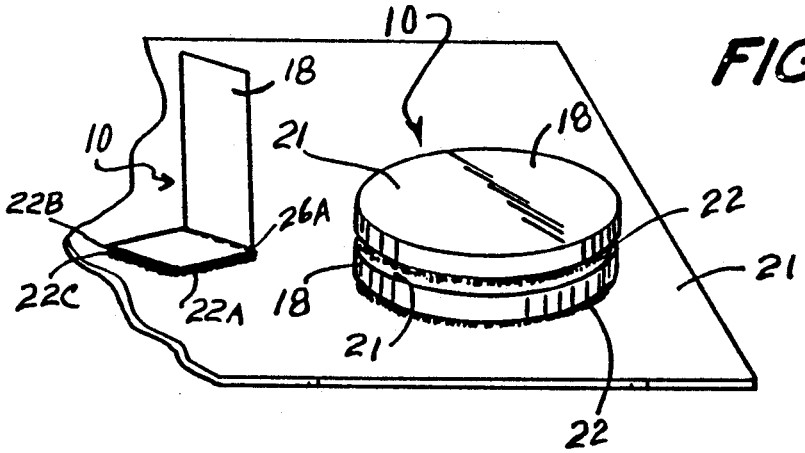

Referring to FIGS. 39,40,47, the subject invention as a reference-aid for marking selected pages of a publication or the like as an indexing apparatus, supplied and issued therewith, may in the alternative, be construed (by definition) to include a reference-aid game marker 18 which may be used in gaming practice. (e.g., instant winner games, lottery, redemption coupons—action initiated, bingo cards with game markers and the like). All that need be required for a game to be played is the use of at least one game marker means which is uniquely capable of being engaged and disengaged at least once or enumerable times due to the employment of the at least one adhesive layer means 22 of a releasable and/or reusable type each layer being at least one of permanently, semi-permanently, semi-temporarily and temporarily applied directly and/or indirectly to at least one attaching means area of at least one face of each game marker member means. Such game marker means 18 is enabled to be individually released from its original removably protective substrate 21 and, following such release therefrom, the game marker means 18 can at least once be adhesively mountingly re-engaged to the corresponding designated placement space 82 provided on one removably protective substrate 21. It is to be understood, however, that one or more game marker members as well as the associated removably protective substrate sheet 21 are formed from at least one substrate thus permitting the game marker or markers to be issued separately from each other and from the game card (substrate with the corresponding matching placement space 82) in the same or different publication. The re-engaging removably protective substrate (game card) carries on at least one of its faces, at least one corresponding designated placement space 82 serving as an area in which to adhesively dispose at least one matching game marker 18 which in turn activates the consumer's possible redemption value as displayed or indicated thereon the game marker itself or the respective substrate to which it is mounted. It is conceivably possible that one or more markers may be required to be disposed on one designated space or multiple spaces 82 enabling the player of the game to be an instant winner. In the example, as seen in FIG. 40, one $500 winning game marker 18 has been removed from its originally engaged substrate 21 and is further shown to be adhesively mountingly re-engaged to the respective corresponding designated placement space 82; the filled spaces determining the appropriate redemption face value (which matches the value indicate on the game marker face). As earlier disclosed in this specification, the adhesive 22 employed on at least one face of each marker member 18 may be releasable and/or reusable substance of at least one adhesive layer means 22 being applied/attached to at least one attaching means area directly and/or indirectly having adhesive coverage which may occupy partially or entirely at least one face of each game marker, if desired. This adhesive provides the function of temporarily adheringly securing each marker member to its respective removably protective substrate 21 which is originally engaged thereto during issuance of perhaps the instant value publication supplement for participation by a player-redeemer.

The recipient of such supplement may find the game supplement (at least one game marker member, the game card substrate or both) to the publication secured externally or internally being disposed therewith. The instructional information on "how-to-play", official rules, etc. may be located on the retaining removably protective substrate (the substrate to which the game markers are re-engaged), the original removably protective substrate and/or on one or both faces of a marker member.

The fact of the subject invention, that the game markers can be re-removed, re-engaged at least once, or enumerably, if desired, as in use of a game marker in chess, due to the use of the unique feature of the releasable and/or reusable adhesive layer means 22 (rather than using a remoistenable gum as disclosed by Siiter in U.S. Pat. No. 3,582,111) provides greater advantages in utility of the present invention. For example, the retailer may require a further activity on the part of the customer to re-remove selected markers (i.e., coupons) from their respective corresponding placement space 82 once in the store and again re-engage the same marker or identical (matching) marker to the pre-purchased product having the same corresponding designated placement space thereon, thus earning redemption value therefrom the product's listed price, etc. (or bar code shown on the product). In another example, the product manufacturer, or gaming commission, etc., may use special machine readable images (e.g. bar-code recognition format) or machine readable inks (e.g. electroconductive ink, magnetic ink, light sensitive invisible ink, etc.) to authenticate the validity of the redeemer-prize winner's game supplement, coupon or the like by simply removing from the designated placement space 82, the game marker 18 to verify by scanning the machine readable information thereon as disclosed in applicant's co-pending application Serial No. 599,734, filed Oct. 19, 1990, now U.S. Pat. No. 5,080,399, issued Jan. 14, 1992.

The removably protective substrate having the corresponding designated placement space as aforesaid may also have the game instructional information imprinted thereon; where such instructional information is corresponding to the use of one or more markers. Each game marker member and its corresponding designated placement space 82 each may have an optional associative corresponding relationship to each other via the identifyably imprinted indicia thereon. (i.e., "Good for $1,000 Rebate with matching identified marker affixed here!").

As further illustrated, the game reference-markers may be optionally positioned and extend only over a pre-determined portion of the original or re-engaging removably protective substrate 21, or in the alternative, may completely cover the entire respectively engaged substrate, as desired. The substrate may act to serve as a retaining support panel either individually and separate from or articulated to the marker member 18 or members along at least one separation line means and/or foldable line means utilized to integrally form the marker member or members from the substrate means.

The identifyably (visual and/or invisible) information means 80 may be one of visually readable means, machine/electronical means, or combination thereof. At least one information concealing and/or distorting covering means 81 may be from the group consisting of friable covering means and non-friable covering means (sheet/film/coating covering means) which may be used individually or in combination and applied/attached over at least one information means area, partially or entirely, to cover selected information on the marker's face 19,20, until use. For example, in application of a game, removal of such information concealing and/or distorting covering means 81 by suitable means to display the specific marker means information may act to augment, diminish and/or qualifying the recipient thereof and/or establish the optional redemptional value, non-redemptional information means as indicated to the patron in exercising the game. Such information concealing/distorting covering means 81 may be further color-coded to depict certain categories of markers or groups of markers which may optionally correspond to certain placement space or spaces 82. Consequently, it is with this subject invention as an adhesively mountingly game marker which may be engaged and disengaged and re-engaged repeatedly which generates consumerplayer activity (including the incentive of the redemption value which is not to be overlooked), increased product brand recognition and consumer interest levels which are peaked with respect to added value product incentives.

Technically speaking, each exposing adhesive layer means of each attaching means area is also in generally face-to-face temporary contact relationship, as mentioned earlier in this specification, to the removably protective substrate both prior to initial removal from the originally engaged substrate and after the marker is re-engaged to the designated placement space 82 of the retaining panel/removably protective substrate being generally parallel thereto.

The subject invention, thus far, has been described in an illustrative manner allowing a variety of versions to be expressed both in the utility of application and physical variated design construction of the reference-aid. Referring to the next series of illustration FIGS. 39-32 and 35-38 will illustrate the same principles employed as the foretold reference-aid has disclosed and still remain within the scope hereof.

In summary, a document/publication cover substrate means having at least one separably removable reference-aid marker apparatus being at least one of an index marker member means, game marker means, coupon marker means in application. The document/publication cover substrate means being for example, a book cover jacket, folder, pocket folder, envelope, overwrap, any suitable multifaced substrated means having at least one interior face surface adapted to cover and/or envelope substrate material in union means (collated, inserted, supplemented—attached or unattached, temporarily or permanently secured thereto). The multi-faced substrate means comprising at least one marker member means and at least one removably protective multi-faced substrate means releasable therefrom. Each of said at least one marker member means on at least one face thereof comprising at least one attaching means area with at least one adhesive layer means attached/applied thereto and covered by at least one removably protective multi-face substrate means being optionally free from intentional treatment of releasable coating means/impregnated adhesive repellant substance means to necessitate removability therefrom. Each marker's at least one face being adheringly releasably engaged to said at least one removably protective multi-face substrate means and further being generally parallel thereto, said at least one adhesive layer means further comprising at least one exposing surface layer means which is at least one of releasable adhesive layer means, reusable adhesive layer means, replaceable adhesive layer means, semi-permanent adhesive layer means and permanent adhesive layer means, wherein said at least one exposing surface layer means is at least one of directly and indirectly applied/attached to said at least one face of said at least one marker member means. Each marker member means and removably protective multi-faced substrate means are at least one of the same said at least one marker member means, a different said at least one marker member means, the same substrate means and a different substrate means. These two apparatus elements may further be at least one of articulated to each other, non-articulated, directly and/or indirectly hingedly connected to each other.

Should at least one optional support/carrier liner 22C be used, it may be sandwiched therebetween at least two adhesive layer means, alternately in layer formation. The support/carrier substrate means may be flexible, semi-flexible, semi-rigid and rigid, wherein said support/carrier substrate means is optionally adapted to accept information means also thereto the substrate, either on the surface and/or impregnated into the substrate itself.

Figure 29:
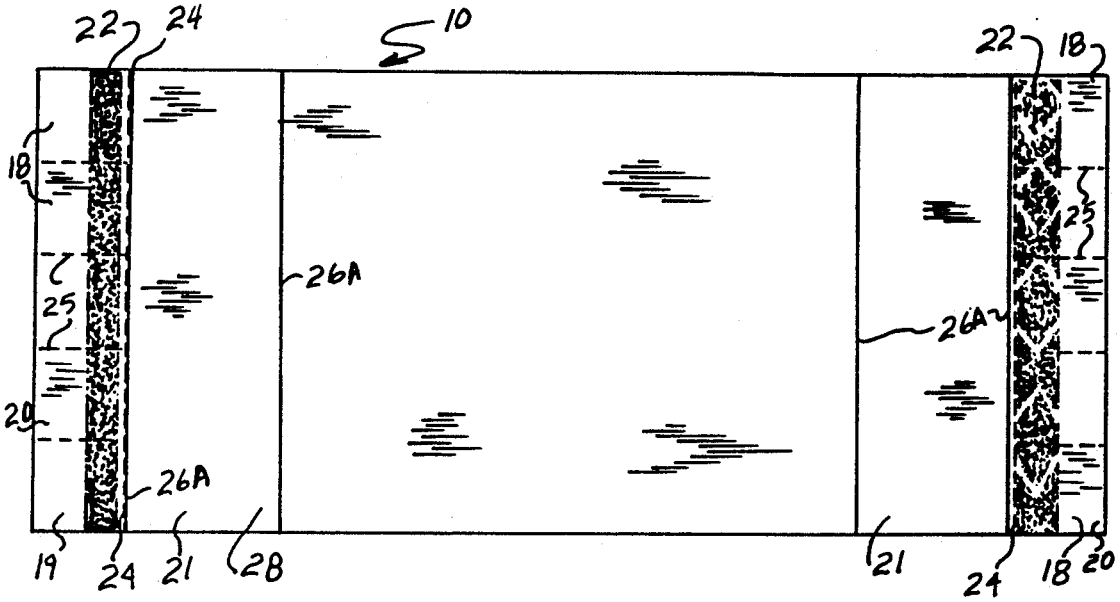
FIGS. 29 and 31 are elevational plan views of the reference-aid of the invention of FIGS. 30 and 32, respectively.
Figure 30:
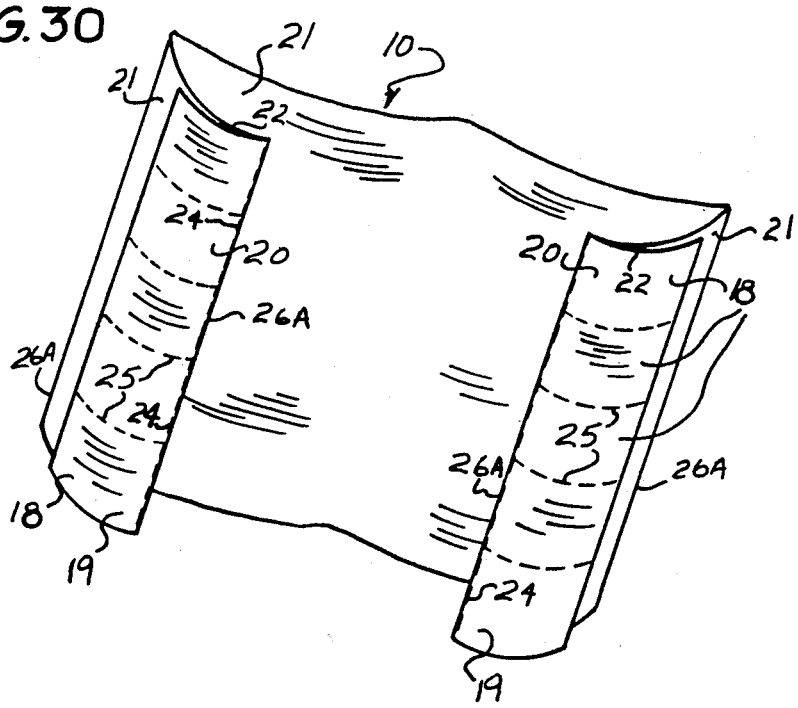
FIGS. 30 and 32 are pictorial views of the reference-aid of the invention incorporated with a book cover jacket, showing the jacket open and the marker panel portion extending therefrom the supporting panel portion to illustrate possible apparatus arrangement embodiments.
Figure 31:
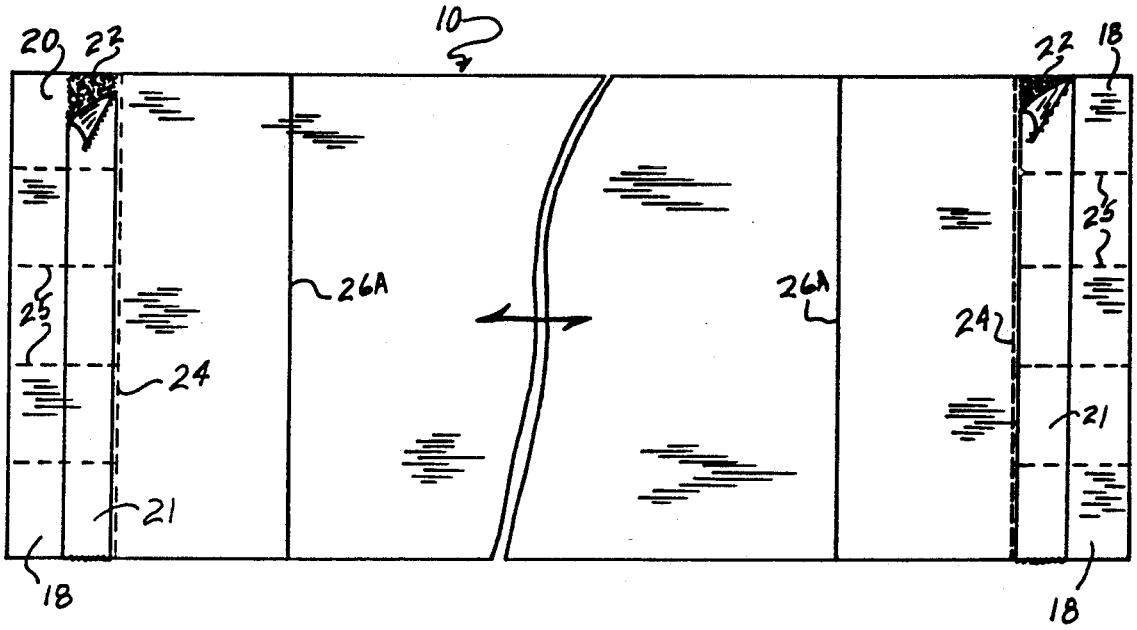
Figure 32:
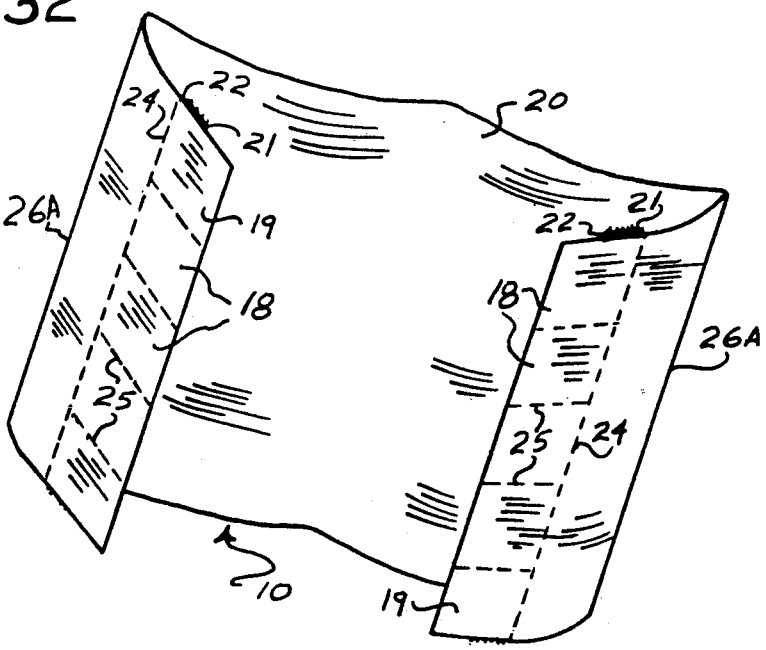
Figure 35:
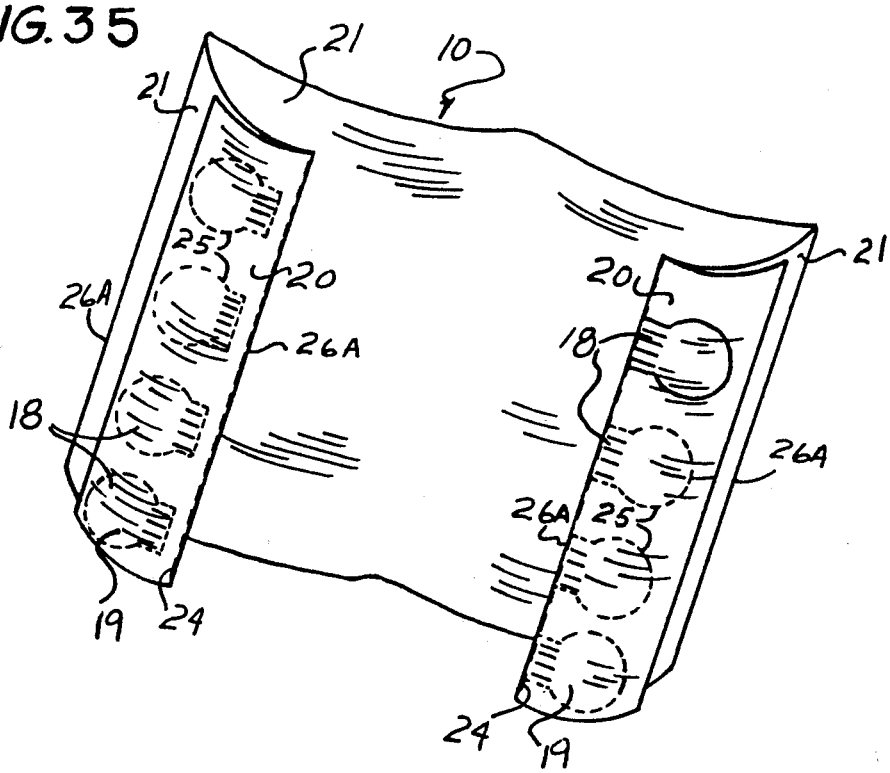
FIG. 35 is a pictorial view of the reference-aid of the present invention incorporated with the inwardly folded panel portions of a book cover jacket, illustrating detachably connected marker members formed by intermittently severable line means from the respective marker panel portion, said marker members having a common releasable cover panel portion formed of the same sheet material.
Figure 37:
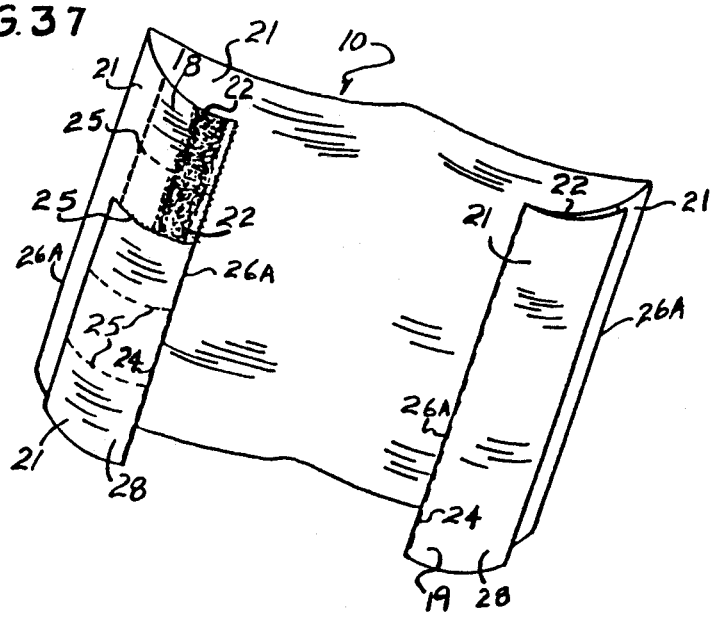
FIG. 37 is a pictorial view of the book cover jacket with reference-aid shown in FIG. 36, showing two segmented releasable cover members detachably removed along the separable line means and the severable line means and revealing the exposed adhesive layer means on the marker members/marker panel portion.
Figure 38:
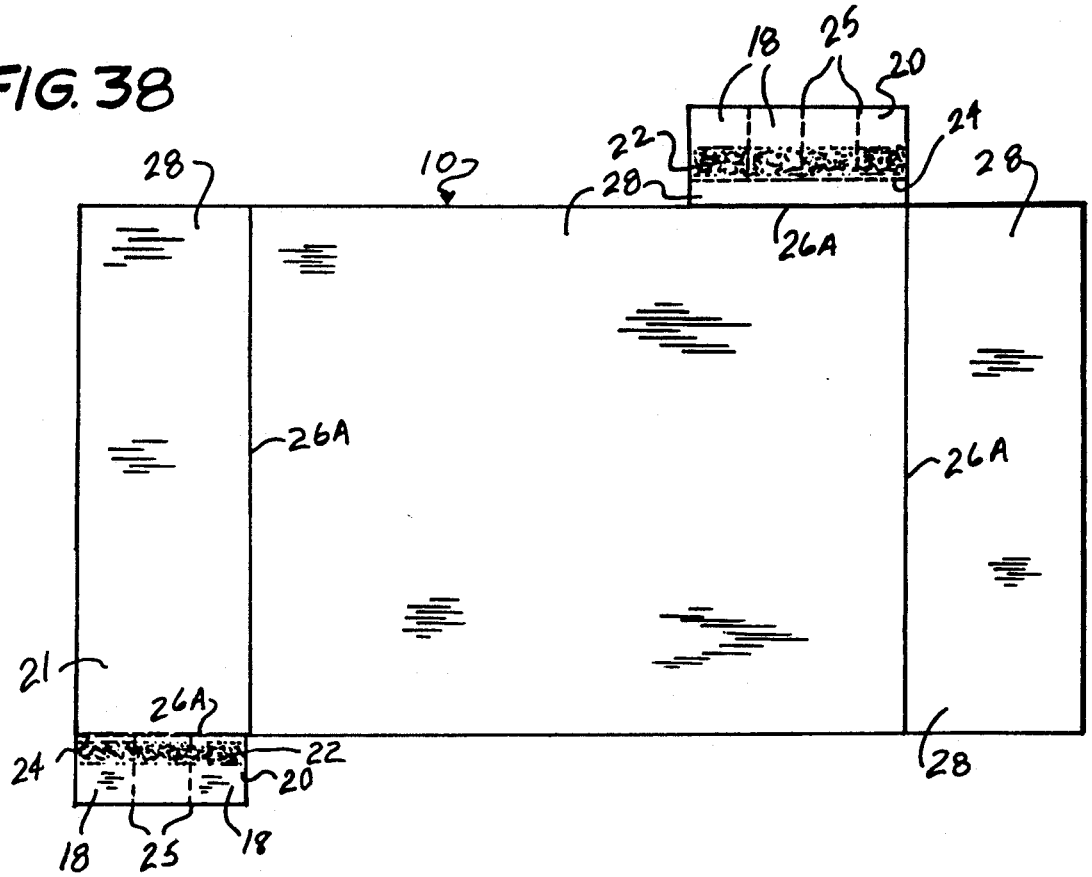
FIG. 38 is an elevational plan view showing the marker panel being hingedly and detachably connected to the support panel portions comprising the book cover jacket.
Figure 41:
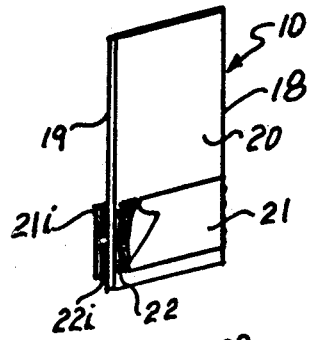
FIG. 41 is a perspective view of the reference-article/aid apparatus illustrating an optionally provided at least one adhesive layer means and covered by at least one release cover means on the other face surface of the marker member means.
Figure 42:
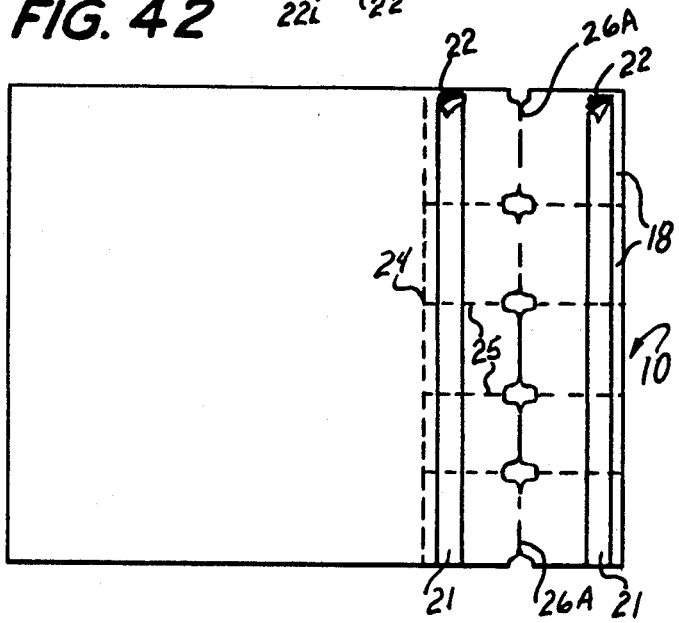
FIG. 42 is another plan view of the reference-aid showing another possible variation being a foldable marker member means bearing adhesive layer means on two attaching means areas of the same face of the marker member means/marker panel portion.
Figure 43:
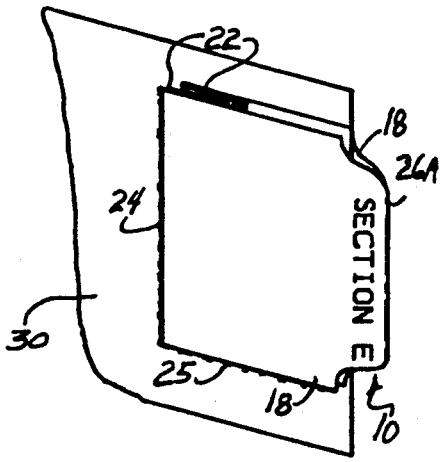
FIG. 43 is a pictorial view showing the formed marker member means in FIG. 42 as mounted in position onto a substrate adhesively engaged on both sides thereof.

More specifically, in view of only a book cover substrate means (exterior publication cover, protective jacket and the like) the article being formed generally of rectangular sheet substrate consisting of a common cover panel portion (support panel 28) having at least one determined/predetermined dimension; the common cover panel portion 28 may optionally have at least one inwardly folding panel portions which optionally act as the removably protective multi-faced covering means 21. It is again important to note that the removably protective covering 21 is optionally free of intentional treatment of release coating means/impregnated adhesive repellant substance to necessitate removability therefrom the marker member or members' 18 at least one exposing surface layer. As may be seen in FIGS. 29–32;35–38, multiple variations of some possible product designs, to exemplify the adaptations of at least one marker member means 18 in construction of such article. A separation line means (continuous and/or interrupted)FIG. 35, shown to be numeral 25, may form, articulate and/or hingedly connect the marker panel portion/each marker member 18 to the support "common" panel portion 28. The marker panel portions shown to directly and/or indirectly attached to the common panel portion, FIG. 38. The document/publication substrate length may be oversized to "overwrap" the respective fore-edge or edges of a book cover, in this particular design. FIGS. 36 and 37 shows variated application of the removably protective substrate 21 being intrasected and non-intrasected panel portion as a "naturally" formed strip of the same sheet stock material which forms the cover substrate jacket, in this example. As can be seen by similarity in other FIGS. 44 and 45, in comparison to the book cover substrate means, the portfolio (pocket type shown in this example embodiment) may also optionally have at least one inwardly foldable panel portion from which the marker members 18 are articulated or hingedly connected (as along the pocket portion, for example) the releasably protective cover substrate means 21 being the intentionally untreated substrate means. FIG. 11 also manifests the reference-aid apparatus formed from the publication vessel's own cover substrate, being inwardly folded thereunder along foldable line 26A. FIGS. 29, 36 exemplify the at least one attaching area in application of the reference-aid apparatus; the sum total of the attaching means area or areas is from about 2% to about 99.9% of the at least one information means area available which substantially occupies each apparatus member. FIG. 41 illustrates a marker member means 18 having at least one attaching means area on at least one face thereof 19, 20 being occupied by at least one adhesive layer means 22 on each of such faces. Such feature in practice permits many possibilities including the optional ability that the adhesive layer means may be replaceably secured to the substrate for removal and replacement, if desired, should the adhesive layer means be rendered ineffective to properly operate as designed. FIG. 42 shows a support panel portion substrate 28 having separably connected marker members thereto 18, such marker having at least one foldable line means 26A permitting a "fold-over" marker member to adheringly attach to a page substrate sheet as can be seen in FIG. 43. This "fold-over" marker design may be selected perhaps when the user wishes increased reinforcement without the employment of a lamination covering means for added durability. FIG. 46 also illustrates a marker member with "self-covering" capability of the non-adhesive area portion of the marker being folded over to act and serve as the removably protective substrate means 21 being optionally free from intentional treatment of releasable coating means/impregnated adhesive repellant substance means to necessitate removability therefrom. FIG. 47 is an another embodiment of the reference-aid apparatus as a reminiscence/-reference game marker application; the illustration showing a double-piece stack wherein two marker member means 18 are adhesively separably unified to each other and to the substrate by at least one adhesive layer means 22. The game markers being in generally temporary contact relationship with each other and/or with the substrate surface 21 being the removably protective multi-faced substrate means.

While the subject invention has been described with respect to preferred alternate embodiments, it will be apparent that various modifications can be made without departing from the spirit and scope of the present invention as defined by the appended claims. For example, it is not essential for each marker member to be formed from the same substrate material. Further the markers may be made from independent substrate means or from that of the removably protective substrate means. Each marker member may be articluated, optionally, to a support panel means 28,21 by at least one foldable line means and/or at least one separation line means 24,25,26. As shown in FIG. 33 is is possible that one or marker member means may be adhesively releasable and non-articulated also to the exterior and/or interior of a document/publication cover substrate means as an alternative to what is illustrated in FIGS. 29-32; 35-38; and 44,45. Should, however, each marker member means be articulated to a support panel means along at least one foldable line means, the fold line is securely/firmly creased to originally engage the exposing surface layer means of each at least one attaching means area. Further, at least one marker member means 18 may optionally be releasably adheringly attached to the common panel portion substrate being a document and/or publication cover substrate means (not shown). The removably protective substrate means may consist of at least one removably protective substrate being optionally defined by at least one separation line means 25 and/or in the alternative may consist of at least one removably mountable marker member having at least one attching means area thereon, if desired. The articulated fold line which joins the substrates to one another, optionally, may extend substantially entirely or partially across the cover substrate and/or support panel portion as required by design. In another modification of the apparatus, each adhesive layer may be at least one of flexible, semi-flexible, semi-rigid and rigid by characteristic definition. The apparatus may further consist of at least one primary marker to identify one or more publication vessels. The removably protective covering substrate may be applied perphaps as a liquid initially, then allowed to cure (dry) forming a multi-faced removable substrate. The substrate from which the apparatus is formed as well as the adhesive layer means may be adaptable to accept/receive topically and/or impregnated at least one supplemental substance means (e.g. perfume fragrance, scent means, flavor substance means, etc).

METHODS OF MANUFACTURE

Referring to the drawings, FIGS. 18-24, a reference-aid apparatus/article 10, in accordance with diverse embodiments of the subject invention, is capable of being fabricated in a multitude of methods without departure herefrom which can be seen from the illustrations. There are, by appearance, two basic distinctions which lie in the manner of application of adhesive layer means 22 to the substrate 71, which is a direct method to apply liquid adhesive/pre-cured adhesive thereto or in the alternative, to indirectly apply/attach the exposing surface adhesive layer means by the vehicle of of at least one other adhesive layer which may be applied before and/or concurrently with the exposing surface layer means. One method of directly applying at least one adhesive layer means thereto the substrate is accomplished as illustrated in FIGS. 18-21. The indirect method is exemplified in FIGS. 22-24 whereby a transfer tape is shown in roll form, for example, carrying at least one adhesive layer means 22 and is being applied across a gang of marker members 18 formed from at least one substrate 71, on the attaching means area of one face 20 of each of the markers 18. The transfer tape is coated or uncoated stock which covers the releasable and/or reusable adhesive layer means which may be pressure sensitive prior to transfering such adhesive layer means by at least of temporarily, semi-temporarily, semi-permanently and permanently to the substrate. The transfer tape or strip 21 is the removably protective substrate and is removed by peeling away from the exposing surface layer means of the adhesive layer means to allow exposure of the applied adhesive layer means 22 on at least one face (shown to be face 20) of each marker/apparatus member 18. In this format, the transfer tape 21 is the releasably protective covering means substrate 21 shown to be flexible of semi-flexible in this example, and made from a "foreign" (different)-non-articulated substrate than the substrate 71 used to form the apparatus 10 (shown to consist of at least one marker member 18). FIG. 24 is somewhat unique in the aspect that an optional support/carrier liner 22C bears and carries at least two adhesive layer means 22A, 22B which may be of differential adhesive bonding strengths or equivalent adhesive bonding strengths on each of its two face surfaces; the one face side is shown to adhesively carry the releasably protective substrate 21 which primarily carries the adhesive layers and sandwiched liner to the substrate 71. For example, the support/carrier liner adhesive bearing face which attaches to the substrate 71 may utilize an aggressive adhesive layer to secure the adhesive layer means thereto and the other one face which obviously carries the exposing surface layer or layers, may utilize an adhesive tack range of non-aggressive to aggressive or combination of mounting adhesive strengths, if desired. At least one attaching means area may be employed on at least one face of each marker/apparatus member, as desired. FIG. 24 further illustrates the removably protective covering 21, each adhesive layer means 22A,22B, including the support/carrier liner 22C along with the sheet substrate 71, being concurrently severed by at least one separation line means, shown to be an interrupted, rather than optional continuous severable line. The apparatus 10 is further illustrated to having been cut/separated from the parent substrate 71. FIG. 22 is a similar view of this process/operation, however, FIG. 23 shows the substrate segmented by at least one separation line means 24,25 and the adhesive layer means with removably protective substrate 21 being applied thereafter to bypass the inclusion of the separation line means engaged to the sheet by press rollers 73, in this example. In another variated method step, the at least one adhesive layer may be only applied by or in conjunction with the transfer carrier covering, the transfer release covering then removed and another different substrate or substrates being engaged such as a publication vessel substrate, independent support panel or articulated and hingedly connected substrate, all capable of acting as the removably protective cover substrate means. In the alternative, the substrate 71 may be folded along a foldable line means 26A running partially or entirely the length of the apparatus to engage originally the adhesive layer means 22 as shown on one face 20 of the apparatus 10 consisting of a gang of marker member 18 with its articulated removably protective substrate/support panel 21, viewed in FIG. 21. Or, the articulated removably protective substrate portion 21 may be folded along a foldable line means 26A to engage originally with the marker or markers 18 formed from the substrate 71, as can be seen in FIG. 19. In the alternative, however, alternating combinations of markers and removably protective covers may be utilized in format design as segmented from the substrate and at least one folding over panel portion (not shown). FIG. 20 demonstrates at least one individual removably protective substrate means being applied to cover at least one attaching means area having at least one adhesive layer means 22 prior to use of the apparatus marker or markers 18. In FIG. 18, shown from rolled form, a removably protective tape 21 is shown to cover the adhesive layer means 22 being directly applied (in liquid) form to the substrate 71; the removably protective cover substrate 21 illustrated as a tape covering being a foreign substrate to the substrate from which the reference-aid is formed. The reference-aid substrate and the removably protective sheet may each be imprinted with information thereto and/or thereon at least one face as an option, if desired. Perforating/imaging (exsecting) the substrate 71 follows, in this example, employing at least one line of separations 24 to form at least one marker member/marker panel portion 18 and now segmented in alignment with the adheringly attached removably protective substrate 21. The at least one separation line means 24, 25 which forms the marker member or members 18 may continue through the releasably protective substrate 21 permitting each marker member 18 and its associated releasably protective cover 21 to be completely removed upon individual selection from the substrate 71 by this design. It is possible that multiple areas of adhesive, perhaps in row form, be applied to the same substrate (shown) FIG. 25, and/or different substrate (not shown) which allows one panel of one or more markers 18 to folded over, as in the direction of the arrows, onto the optionally articulated marker panel portion, shown to be optionally adjacent thereto in one version; the at least one adhesive layer means 22 being optionally alternated in position to allow the nonadhesive area portion to act and serve as the removably protective cover substrate to releasably engage with the exposing surface adhesive layer means.

Once the at least one adhesive layer means 22 as shown in FIGS. 18–21 to be applied to at least one face of each apparatus/marker member or members, in a wet state of condition, the applied adhesive layer 22 must "cure" by exsiccating (drying). Following the curing step (not required when applying the pre-cured adhesive layer means from the transfer carrier acting as the removably protective substrate) the engaging step/folding step is required to cover the cured adhesive layer or layers, unless, however, the reference-aid is internally/externally disposed with a publication vessel (i.e. insert, cover panel, page leaf, etc.) acting and serving as the removably protective substrate until use of the apparatus. The folding step engages originally the exposing surface layer on at least one face of the marker member or members 18, 11 as a panel portion articulated to the support panel substrate 28 acting as the removably protective substrate 21 in practice. Optionally cutting/trimming/die-cutting the apparatus from the substrate 71 (where applicable) and further subsequent optional cutting and/or trimming the reference-aid apparatus to at least one determined/predetermined dimension. The size may be a concern for that apparatus which is to be supplemented in an optional step with a publication vessel for issuance/distribution therewith. It is important to note, the supplementation step may include concurrently the engaging step, should the designer wish to utilize the publication substrate (exterior and/or interior) as the untreated and/or treated means removably protective substrate covering 21.

In summary, a method of manufacturing a reference-aid article apparatus comprising the steps of a) optionally identifying by imaging at least one face of at least one multi-faced substrate means with information means thereon; b) defining at least one marker member means from at least one marker panel portion/substrate by at least one separation/defining line means; c) applying at least one adhesive layer means thereto at least one attaching means area on at least one face of each apparatus/marker member; d) optionally folding at least one said at least one multiple-faced substrate means along at least one foldable line means to releasably cover said at least one adhesive layer means on said at least one face of said at least one marker/apparatus member; e) optionally engaging at least one of said at least one face of said at least one marker/apparatus member with at least one substrate means being at least one releasable cover means; f) optionally cutting at least one reference-article apparatus from said at least one multiple-faced substrate means to at least one determined/predetermined dimension. g) optionally supplementing at least one reference-aid apparatus with a publication vessel for issuance/distribution therewith.

In view of the above steps the series of production steps desired may be carried out in any suitable sequential order of production. Further, each production step may be partially or entirely performed during at least one production step permitting desired to steps to be repeated within the process. It is to also noted, that at least one production step may be performed during at least one production operation step, thereby making it possible for two or more steps to be performed concurrently at the same station of operation. It is not essential that the identifying step of imaging be incorporated within the process, so therefore, it may be eliminated altogether as an option. The optional supplementation-/incorporation step incorporates the reference-aid apparatus with another publication substrate/vessel. It is at this time of supplementation step that the engaging step may be concurrently and/or individually employed in the operational series of steps. Further, optionally within the series of steps at least one supplemental integrating step (e.g. scent application) may be included in the operational process; this step may apply and/or impregnate at least one supplemental substance in any order of production as deemed suitable. The defining step(b) may optionally define at least one support panel portion from the marker panel portion/apparatus. The operational steps may be individually, concurrently/-simultaneously, partially and/or entirely performed in any suitable order of operation without departure herefrom the spirit and scope of the present invention.

Other modified methods of manufacturing the reference-aid may be possible without departure from the interchangeable process steps and from the spirit and scope of the subject invention while still permitting the final product to essentially have the unique composition of components which has rendered it unobvious and patentable over the prior art. For instance, one or more substrates may bear/carry individual markers (non-articulated) or apparatus members being releasably adheringly engaged to an intentionally untreated substrate sheet free of release coating means/impregnated adhesive repellant substance means; this untreated substrate becoming in releasable union with each apparatus member as a removably protective substrate means. The adhesive lay down on the marker/apparatus substrate surface or surfaces may be to cover partially and/or entirely, the at least one attaching means area of each member utilizing at least one adhesive layer means—rather than simply laying an adhesive coating entirely on the back of a sheet and die cutting labels (not shown) therefrom. In another variation of manufacture, the image defining and/or perforation step and folding step may occur concurrently in the same operational step. Further, during the folding step, the substrate 71 may be folded at least once to form a flap, accordian pleat, coil form and be folded along at least one separation line means which may be the a "common" shared line or independent line from the foldable line means.

Where the reference-aid 10 is determined/predetermined to be disposed with the publication prior to issuance/distribution, the physical panels of the publication, as previously mentioned, may serve as the removably protective cover substrate 21, thereby eliminating the folding step as stated. However, in this senario, the emphasis point now is that the engaging step and the cutting/trimming step are reversed in order of production, to optionally cut/trim the apparatus along with trimming the publication during production.

The subject invention has been described in an illustrative manner to demonstrate only some of the enumerable practical versions of the embodiments which are possible in practice hereof without limitation and departure from the principle accomplishments set forth herein, the unobvious and novel advantages definitively disclosed and the spirit and scope which ferverously encompasses the novel creation for the magnitude of exclusive privileges and rights herein as well as utility protection for which this application seeks to secure and provide to the holder hereof.

Obviously, many modifications and variations of the present invention are possible in light of the above teachings and it is to be understood that the terminology used to convey the thought is intended to be in the nature of words of description rather than of limitation of languaged employed. It is therefore to be understood, that within the scope of the appended claims that descriptive language is not to be in anyway limiting since the subject invention may be accomplished and practice otherwise than as specifically described herein without departure herefrom.

What I claim and desire to secure by Letters Patent is:

1. A document/publication cover substrate means having at least one separably removable reference-aid marker apparatus, said document/publication cover substrate means comprising:

at least one multi-faced substrate means comprising at least one multi-face substrate means having at least one interior face surface adapted to cover and/or envelope substrate material in union means therewith;

said multi-face substrate means comprising at least one marker member means and at least one removably protective multi-face substrate means releasable therefrom;

each of said at least one marker member means on at least one face thereof comprising at least one attaching means area with at least one adhesive layer means attached/applied thereto and covered by at least one removably protective multi-face substrate means;

said at least one face being adheringly releasably engaged to said at least one removably protective multi-face substrate means and further being generally parallel thereto, said at least one adhesive layer means further comprising at least one exposing surface layer means and said at least one removably protective multi-face substrate means being in generally face-to-face temporary contact relationship to each other permitting release and at least one mounting of said at least one marker member means to a border margin and/or surface of at least one publication vessel means.

2. A document/publication cover substrate means of claim 1 wherein said removably protective multi-face substrate means is constructed from at least one of at least one covering substrate means, at least one marker member means, the same substrate means and different substrate means, wherein said at least one removably protective multi-face substrate means is optionally free from any intentional treatment of releasable coating means/impregnated adhesive repellant substance means from any one selected face thereof to which said at least one marker member means is adheringly releasably engaged thereto.

3. A document/publication cover substrate means of claim 1 wherein at least one of said at least one marker member means and said at least one removably protective multi-faced substrate means is at least one of at least one publication substrate means and at least one support panel means.

4. A document/publication cover substrate means of claim 1 wherein said at least one marker member means and said at least one removably protective multi-face substrate means are each at least one of articulated, non-articulated, directly and/or indirectly hingedly connected to each other.

5. A document/publication cover substrate means as in claim 1 wherein said at least one exposing surface layer means is at least one of releasable adhesive layer means, reusable adhesive layer means, replaceable adhesive layer means, semi-permanent adhesive layer means and permanent adhesive layer means, wherein said at least one exposing surface layer means is at least one of directly and indirectly applied to said at least one face of said at least one marker member means.

6. A document/publication cover substrate means as in claim 1 wherein said at least one marker member means is at least one of an index marker member, game marker means, coupon marker means, wherein said at least one marker member means is optionally covered on at least one non-adhesive area portion with at least one information concealing and/or information distorting covering means being at least one of a friable covering means and non-friable covering means.

7. A document/publication cover substrate means as in claim 1 wherein said at least one marker member means and said at least one removably protective multi-face substrate means are at least one of the same said at least one marker member means, a different said at least one marker member means, the same substrate means and a different substrate means.

8. A reference-aid article adapted for indexing use with and/or reminiscence marking of at least one paginated and/or non-paginated publication vessel means, said reference-aid article comprising:

at least one multi-face substrate means, said at least one multi-face substrate means adapted to accept information means on at least one face thereof;

said at least one multi-face substrate means comprising at least one marker means and at least one removably protective multi-face substrate means releasable therefrom;

each of said at least one marker member means on at least one face thereof comprising at least one attaching means area with at least one adhesive layer means attached/applied thereto and covered by at least one removably protective multi-face substrate means being optionally free from intentional treatment of releasable coating means/impregnated adhesive repellant substance means to necessitate removablity therefrom;

said at least one face being adheringly releasably engaged to said at least one removably protective multi-face substrate means and further being generally parallel thereto, said at least one adhesive layer means further comprising at least one exposing surface layer, said at least one exposing surface layer and said at least one removably protective multi-face substrate means being in generally face-to-face temporary contact relationship to each other permitting release and at least one mounting of said at least one marker member means to at least one border margin and/or at least one surface of at least one publication vessel means.

9. A reference-aid article as in claim 8 wherein at least one optional support/carrier substrate means sandwiched therebetween at least two adhesive layer means is at least one of flexible, semi-flexible, semi-rigid and rigid, wherein said support/carrier substrate means is optionally adapted to accept information means thereto.

10. A reference-aid article as in claim 8 wherein at least one of said at least one marker member means and said at least one removably protective multi-faced substrate means is at least one of at least one publication substrate means and at least one support substrate means.

11. A reference-aid article as in claim 8 wherein said at least one marker member means and said at least one removably protective multi-faced substrate means are each at least one of articulated, non-articulated, directly and/or indirectly hingedly connected to each other.

12. A reference-aid article as in claim 8 wherein said at least one exposing surface layer is at least one of releasable adhesive layer means and reusable adhesive layer means at least once, wherein said at least one exposing surface layer is at least one of directly and indirectly applied to said at least one attaching means area of said at least one face of said at least one marker member means.

13. A reference-aid article as in claim 8 wherein said at least one marker member means is at least one of an index marker means, game marker means, coupon marker means, wherein said at least one marker member means is optionally covered on at least one non-adhesive area portion with at least one of information concealing and/or information distorting covering means being at least one of a friable covering means and non-friable covering means.

14. A reference-aid article as in claim 8 wherein said at least one marker member means and said at least one removably protective multi-faced substrate means are at least one of the same said at least one marker member means, a different said at least one marker member means, the same substrate means and a different substrate means.

15. A reference-aid apparatus adapted for use as a game/reference marker means and/or coupon marker means, said reference-aid apparatus comprising:

at least one multi-faced substrate means, said at least one multi-faced substrate means adapted to receive at least one information means on at least one face thereof;

said at least one multi-faced substrate means comprising at least one marker member and at least one removably protective multi-faced substrate means releasable therefrom;

each of said at least one marker member means on at least one face thereof comprising at least one attaching means area with at least one pressure sensitive adhesive layer means attached/applied thereto and covered by at least one removably protective multi-faced substrate means;

said at least one face being adheringly releasably engaged to said at least one removably protective multi-face substrate means and further being generally parallel thereto, said at least one adhesive layer means further comprising at least one exposing surface layers means, said at least one exposing surface layer means and said at least one removably protective multi-faced substrate means being in generally face-to-face temporary contact relationship to each other permitting release and at least one mounting of said at least one marker member means to at least one substrate surface and/or at least one publication vessel means substrate.

16. A reference-aid apparatus as in claim 15 wherein said at least one removably protective multi-faced substrate means is optionally free of any intentional treatment of releasable coating means/impregnated adhesive repellant substance means from any one face thereof to which said at least one marker member means is adheringly releasably engaged thereto.

17. A reference-aid apparatus as in claim 15 wherein at least one of said at least one marker means and said at least one removably protective multi-faced substrate means is at least one of at least one publication substrate means and at least one support panel means.

18. A reference-aid apparatus as in claim 15 wherein said at least one marker member means and said at least one removably protective multi-faced substrate means are each at least one of articulated, non-articulated, directly and/or indirectly hingedly connected to each other.

19. A reference-aid apparatus as in claim 15 wherein said at least one exposing surface layer means is at least one of releasable, reusable, replaceable, semi-permanent and permanent to the mounting substrate means, wherein said at least one exposing surface layer means is at least one of directly and indirectly applied to said at least one attaching means area of said at least one face of said at least one marker member means.

20. A reference-aid apparatus as in claim 15 wherein said at least one marker member means and said at least one removably protective multi-faced substrate means are at least one of the same at least one marker member means, a different said at least one marker member means, the same substrate means and a different substrate means.

* * * * *